US012800196B2

(12) United States Patent
Hanslik et al.

(10) Patent No.: US 12,800,196 B2
(45) Date of Patent: Nov. 17, 2026

(54) HEAT PUMP

(71) Applicant: Vertiv S.r.l., Piove di Sacco (IT)

(72) Inventors: Florian Hanslik, Munich (DE); Julius Rümelin, Munich (DE); Anian Richter, Munich (DE); Reiner Rennschmid, Stubenberg (DE)

(73) Assignee: Vertiv S.r.l., Piove di Sacco (IT)

( * ) Notice: Subject to any disclaimer, the term of this patent is extended or adjusted under 35 U.S.C. 154(b) by 54 days.

(21) Appl. No.: 18/847,582

(22) PCT Filed: Apr. 5, 2023

(86) PCT No.: PCT/EP2023/059008
§ 371 (c)(1),
(2) Date: Sep. 16, 2024

(87) PCT Pub. No.: WO2023/194476
PCT Pub. Date: Oct. 12, 2023

(65) Prior Publication Data

US 2025/0207828 A1 Jun. 26, 2025

(30) Foreign Application Priority Data

Apr. 7, 2022 (DE) ..... 10 2022 203 520.8

(51) Int. Cl.
*F25B 41/40* (2021.01)
*F25B 30/02* (2006.01)
*F25B 39/00* (2006.01)

(52) U.S. Cl.
CPC ..... *F25B 30/02* (2013.01); *F25B 39/00* (2013.01); *F25B 41/40* (2021.01);
(Continued)

(58) Field of Classification Search
CPC ..... F25B 30/02; F25B 41/40; F25B 39/00; F25B 2339/047; F25B 2400/07; F25B 2500/09
See application file for complete search history.

(56) References Cited

U.S. PATENT DOCUMENTS

2002/0073727 A1* 6/2002 Sheehan ..... F25B 29/006 62/324.4
2008/0141525 A1* 6/2008 Breiding ..... F28F 9/262 29/726.5
2014/0047862 A1 2/2014 Tamura et al.

FOREIGN PATENT DOCUMENTS

CN 104936673 A * 9/2015 ..... B01D 45/08
EP 2068099 A2 6/2009
(Continued)

OTHER PUBLICATIONS

FOR1, Droplet Separator And Evaporator, 2015, Full Document (Year: 2015).*

(Continued)

*Primary Examiner* — Nael N Babaa
(74) *Attorney, Agent, or Firm* — HARNESS, DICKEY & PIERCE, P.L.C.

(57) ABSTRACT

A heat pump (100) with an evaporator (50) for evaporating a fluid in order to obtain an evaporated fluid is described, the evaporator (50) having an evaporator sump (52); with a condenser (60) for condensing a compressed fluid, the condenser (60) having a condenser sump (64); with a compressor having a first compressor stage (10) and a second compressor stage (20), the compressor being arranged in the flow direction of the evaporated fluid during operation of the heat pump (100) between the evaporator (50) and the condenser (60) and being designed to compress the evaporated fluid in order to obtain the compressed fluid; with a container (45) for collecting an intermediate cooling
(Continued)

Figure 1:
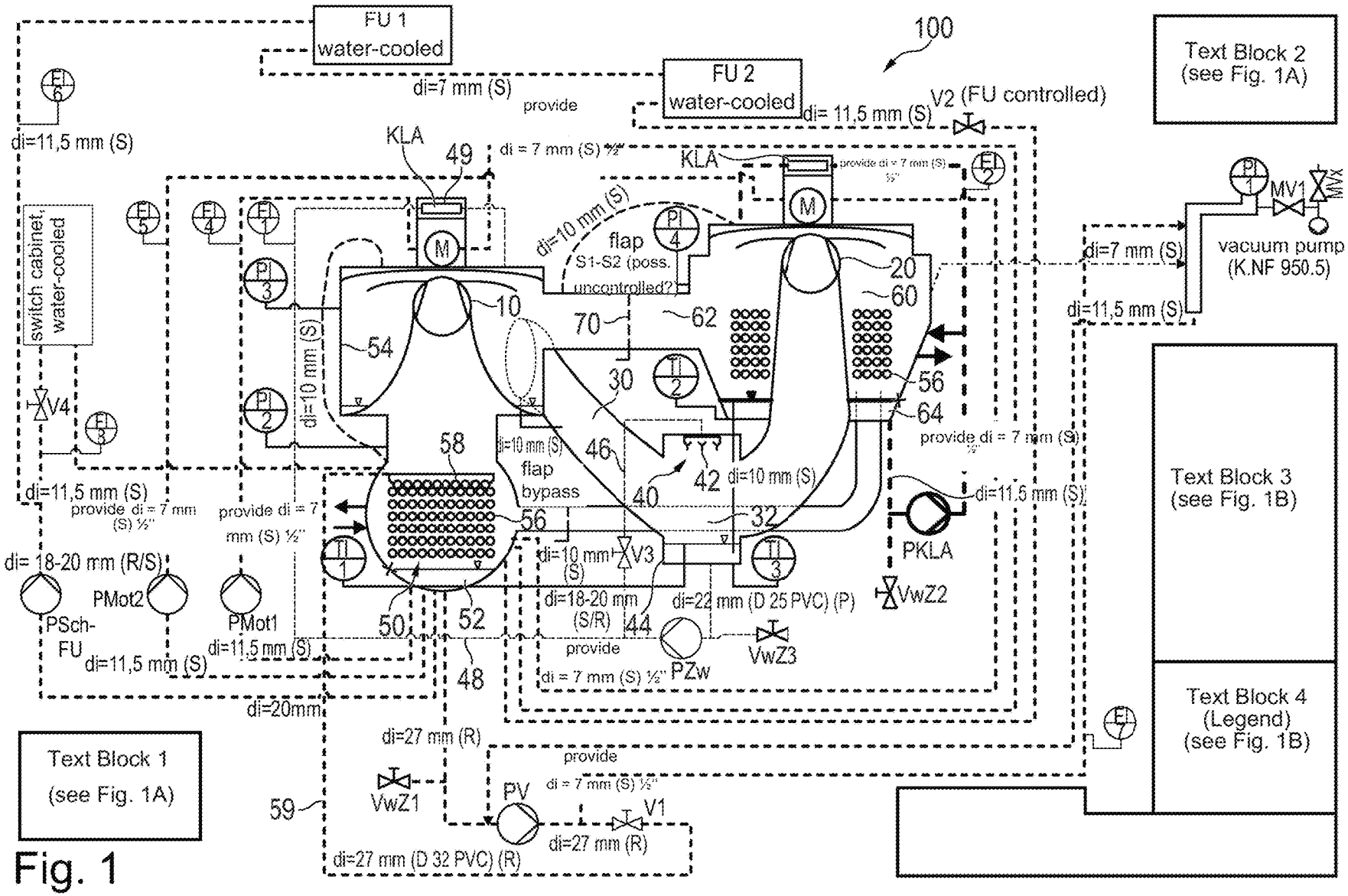

fluid; and with a heat exchanger (82) having a pipe (56) which is designed such that the intermediate cooling fluid flows through it from the container (45), the pipe (56) being arranged in a flow region (11) between the first compressor stage (10) and the second compressor stage (20) in order to cool vaporous fluid in the flow region (11). Furthermore, methods for operating and producing the heat pump are described.

17 Claims, 21 Drawing Sheets

(52) U.S. Cl.
CPC ..... *F25B 2339/047* (2013.01); *F25B 2400/07* (2013.01); *F25B 2500/09* (2013.01)

(56) References Cited

FOREIGN PATENT DOCUMENTS

| | | | |
|---|---|---|---|
| EP | 3203164 | B1 | 4/2021 |
| JP | H06257890 | A | 9/1994 |
| JP | 2017110864 | A | 6/2017 |

OTHER PUBLICATIONS

T. Shoyama et al., "Novel Turbo Compressor for Heat Pump Using Water as Refrigerant and Lubricant", International Conference on Compressors and their Systems 2019, IOP Conf. Series: Materials Science and Engineering 604, 2019, 604, 4 pages, doi:10.1088/1757-899X/604/1/011010.

International Search Report of the International Searching Authority, issued in PCT/EP2023/059008, mailed Jun. 27, 2023; ISA/EP.

* cited by examiner

| DESIGNATION | PLAIN TEXT |
|---|---|
| FU | frequency converter |
| KLA | ball bearing adapter |
| M | motor |
| MV | vacuum valve |
| MVx | vacuum valve ventilation |
| VwZx | valve water supply |
| Vx | valve |
| di | inside diameter |
| (S/R) | hose/pipe |
| X | gauge glass filling level |

Text Block 1

| DESIGNATION | PLAIN TEXT |
|---|---|
| PKLA | pump KLA cooling 2 (Para 30-180/6-43/SC-12) |
| PZw | pump intermediate cooling and KLA 1 (Para 30-180/6-43/SC-12) |
| Pv | pump sprinkling evaporator (Para 30-180/6-43/SC-12) |
| PSch-FU | pump switch cabinet cooling (Para 30-180/6-43/SC-12) |
| PMot 1 | pump motor compressor (Para 30-180/6-43/SC-12) |
| PMot 2 | pump motor compressor (Para 30-180/6-43/SC-12) |

Text Block 2

Fig. 1A

| No. | Sensor (type) |
|---|---|
| TI 1 | temp. D1 evaporator sump |
| TI 2 | temp. D2 condenser sump |
| TI 3 | temp. intermediate cooling sump |
| | |
| | |
| | |
| PI 1 | pressure foreign gas suction |
| PI 2 | pressure D1 evaporator |
| PI 3 | pressure D1 intermediate circuit |
| PI 4 | pressure D2 condenser |
| | |
| | |
| | |
| | |
| | |
| | |
| | |
| | |

Text Block 3

| LINE | LEGEND |
|---|---|
| | intermediate circuit hydraulics |
| | evaporator hydraulics |
| | liquefier hydraulics |
| | foreign gas suction |
| | pressure compensation |
| | cooling water external |
| | cold water external |
| | throttle |

Text Block 4

Fig. 1B

HEAT PUMP

CROSS-REFERENCE TO RELATED APPLICATIONS

This application is a 371 U.S. National Phase of International Application No. PCT/EP2023/059008, filed on Apr. 5, 2023, which claims priority to German Application No. 10 2022 203 520.8, filed on Apr. 7, 2022. The entire disclosures of the above applications are incorporated herein by reference.

The present invention relates to the field of heat pumps, and in particular to concepts for improving the efficiency of a heat pump.

Figure 20:
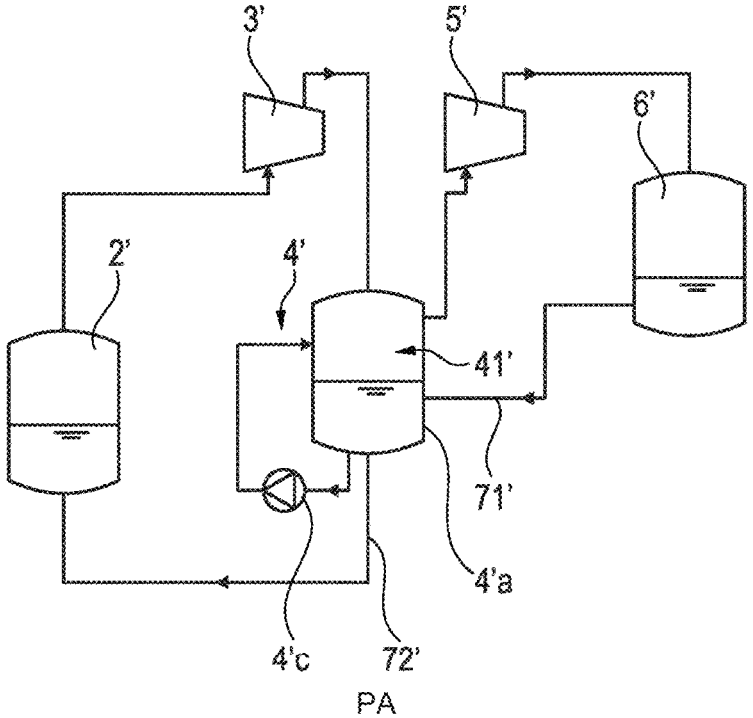

EP 3 203 164 describes a heat pump. FIG. 20 shows the prior art from EP 3 203 164. The heat pump of EP 3 203 164 is operated with water as the coolant. The water is conducted from the sump of the condenser 6' through the supply line 71' to the sump of the intermediate cooling stage. The supply line 71' goes from the sump of the intermediate cooling stage to the sump of the evaporator 2', as a result of which the coolant is returned. The further supply line 72' goes from the sump 4*a*' of the intermediate cooling stage 4' to the sump of the evaporator 2', as a result of which the coolant is returned to the evaporator. The pump 4*c*' conducts the cooling water for sprinkling on the upper side of the container 41' of the intermediate cooling, in order to cool the superheated steam leaving the compressor 3'. EP 3 203 164 discloses direct cooling comprising direct sprinkling. In the case of direct sprinkling, the superheated steam flowing out of the first compressor is cooled down to saturated steam temperature by sprinkling with water from the sump of the intermediate cooler. In this case, the sprinkling can form droplets which are carried along by the vapour further in the direction of the second compressor 5' and may damage this on account of droplets striking at the impeller. Furthermore, the superheated steam is first cooled in the intermediate cooler. The water collected in the sump of the intermediate cooling therefore already corresponds virtually to the saturated steam temperature. For deheating the superheated steam to saturated steam temperature level, this requires a relatively large surface or long contact time between the water and the vapour. Typically, cooling systems are limited to only a limited range of power output. In order to be able to react simultaneously to higher and lower cooling capacities, the compressors have to be activated/deactivated frequently. In EP 3 203 164 B, for example, a flap is provided between the different compressors.

In the publication Novel Turbo Compressor for Heat Pump Using Water as Refrigerant and Lubricant, by T. Shoyama et al. 2019, IOP Conf.: Mater. Sci. Eng. 604011010, a compressor for a heat pump comprising a vapour bypass V0 is described, which taps off the vapour directly after the compressor (see FIG. 21). The vapour conduction proceeds from the outlet of the second compressor C2 back to the inlet of the first compressor C1.

Typically the power consumption of the first compressor stage is used as a reference variable for the second compressor stage. This results in that the two compressor stages (first and second compressor stage) contribute a similar pressure ratio to the overall pressure ratio, since both rotate at approximately the same speed. As a result, the flow through the second compressor is not optimal. This is particularly problematic in the case of high pressure ratios, because on account of the ambient temperature and the control of the second compressor by the power consumption of the first compressor, a variety of vapour volume flows results. The liquefaction and re-evaporation in the intermediate circuit leads to a thermodynamic loss, such that the pressure ratios of the compressor stages do not fully contribute to the overall compression ratio. This is a problem in particular for the second compressor.

The object of the present invention consists in providing an improved heat pump which in particular has an improved design for heat exchange of a fluid circulating in the heat pump, such as a cooling fluid.

This object is achieved by a heat pump according to claim 1.

The heat pump according to the present invention comprises an evaporator for evaporating a fluid in order to obtain an evaporated fluid, wherein the evaporator has an evaporator sump, and a condenser for condensing a compressed fluid, wherein the condenser has a condenser sump. Furthermore, the heat pump comprises a compressor having a first compressor stage and a second compressor stage, wherein the compressor is arranged in the flow direction of the evaporated fluid, during operation of the heat pump, between the evaporator and the condenser, and is configured to compress the evaporated fluid in order to obtain the compressed fluid; a container for collecting an intermediate cooling fluid; and a heat exchanger having a pipeline, which is configured for the intermediate cooling fluid to flow through from the container, wherein the pipeline is arranged in a flow region between the first compressor stage and the second compressor stage, in order to cool vaporous fluid in the flow region.

Of course, individual aspects which are described with reference to the heat pump can also be implemented as method steps, and vice versa. Further details are discussed in the context of the following description of the drawings.

Figure 2:
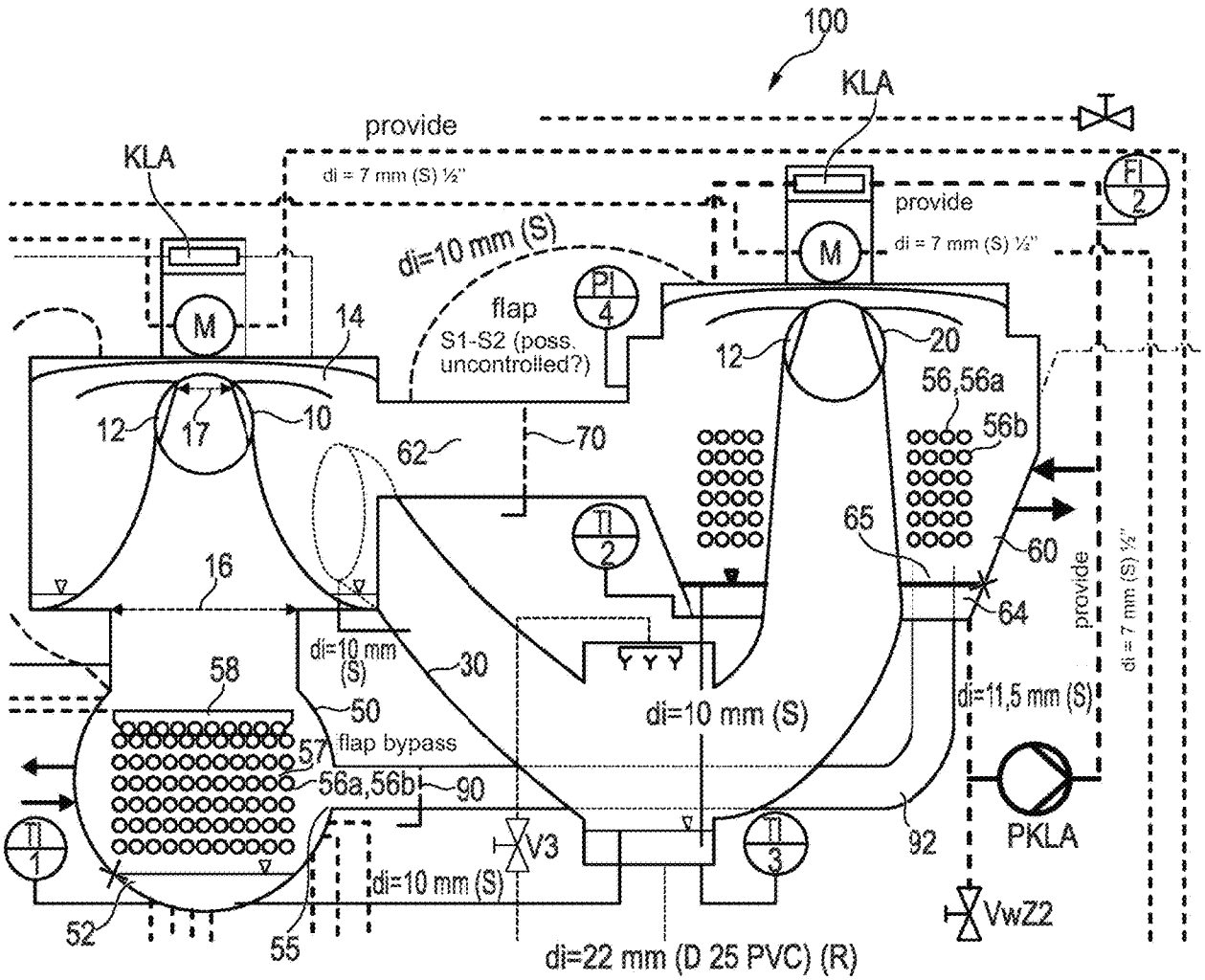
Figure 3:
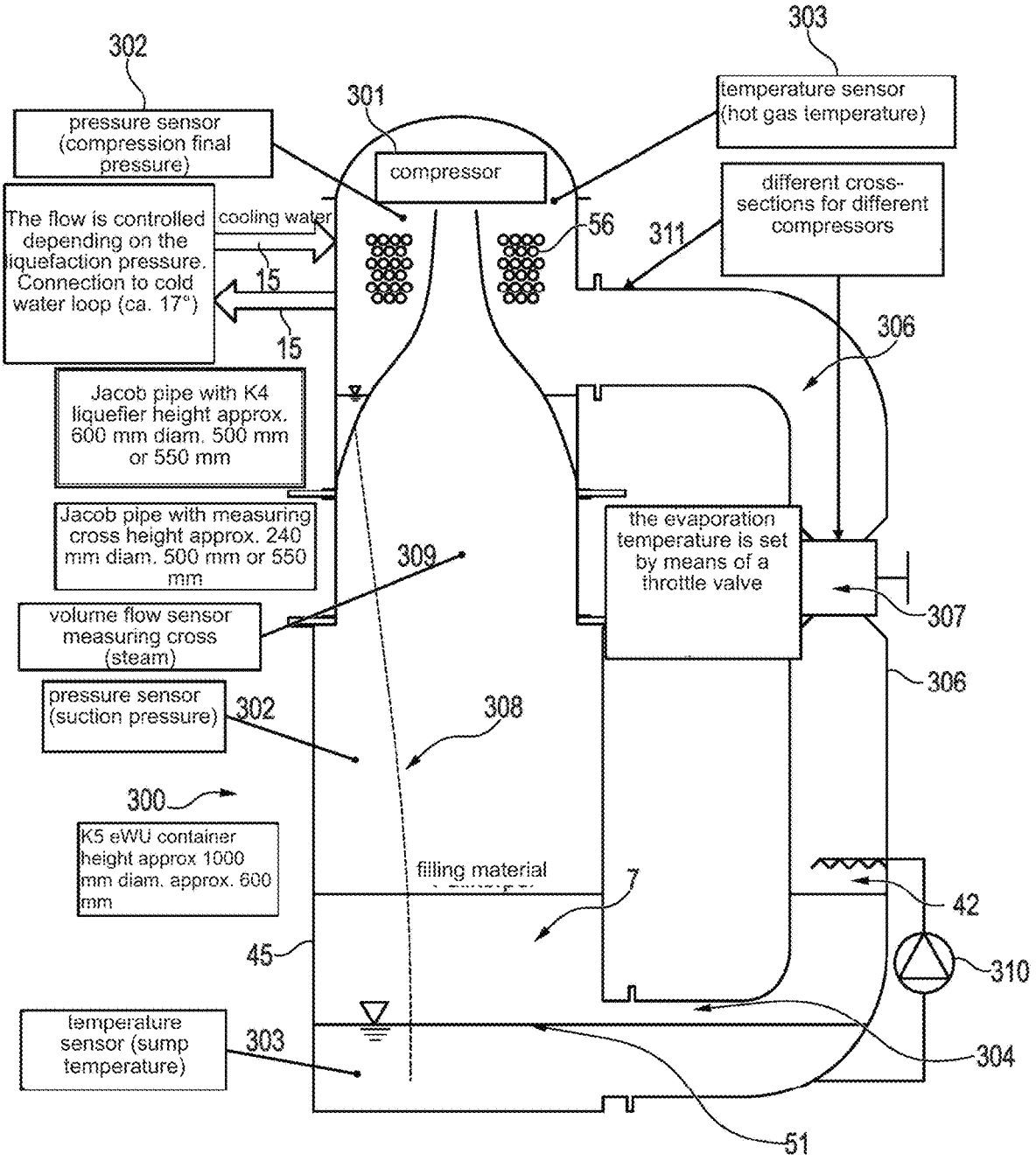
Figure 4:
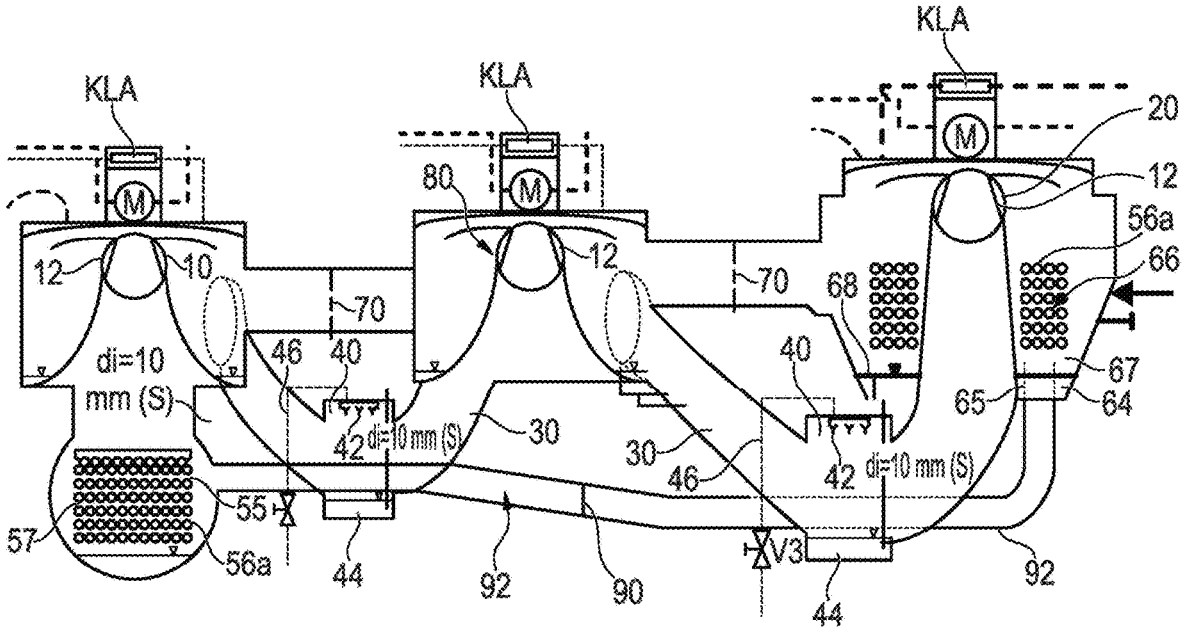
Figure 5:
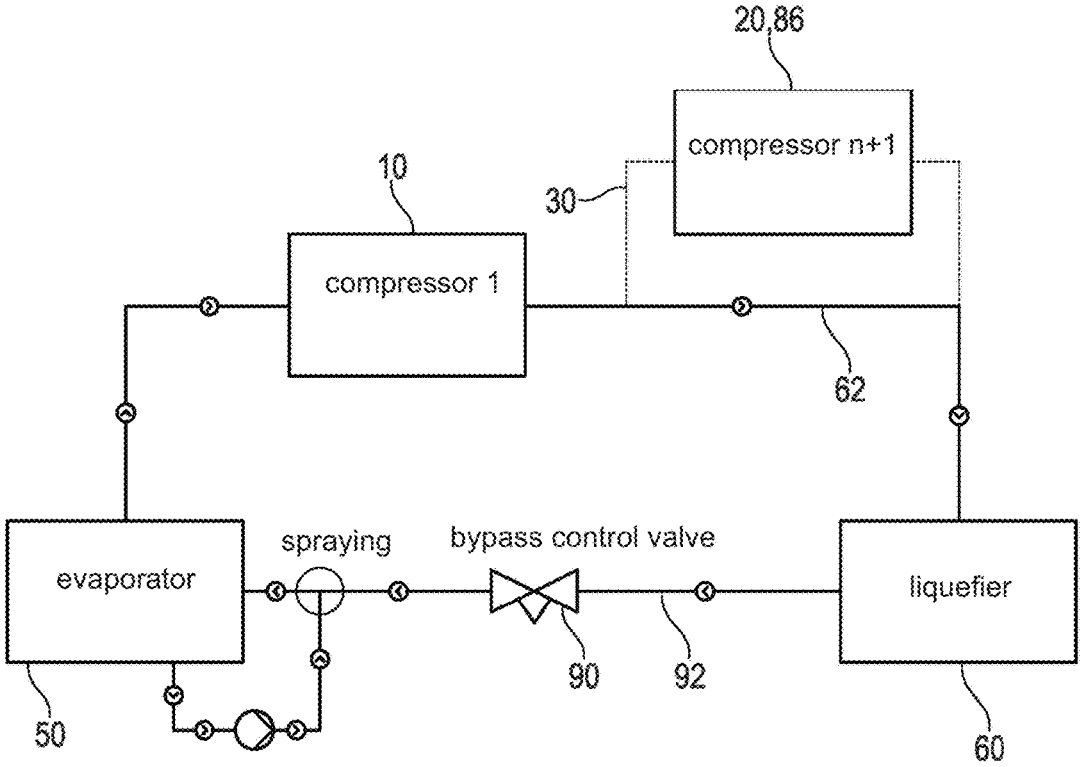
Figure 6:
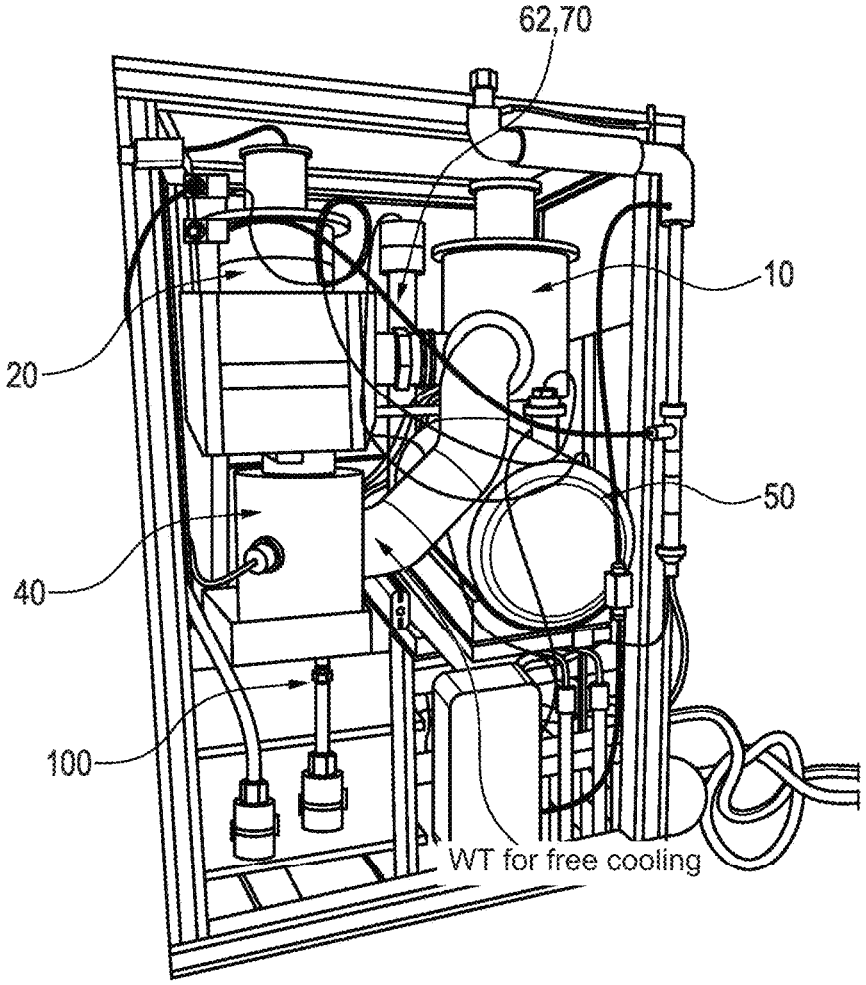
Figure 7:
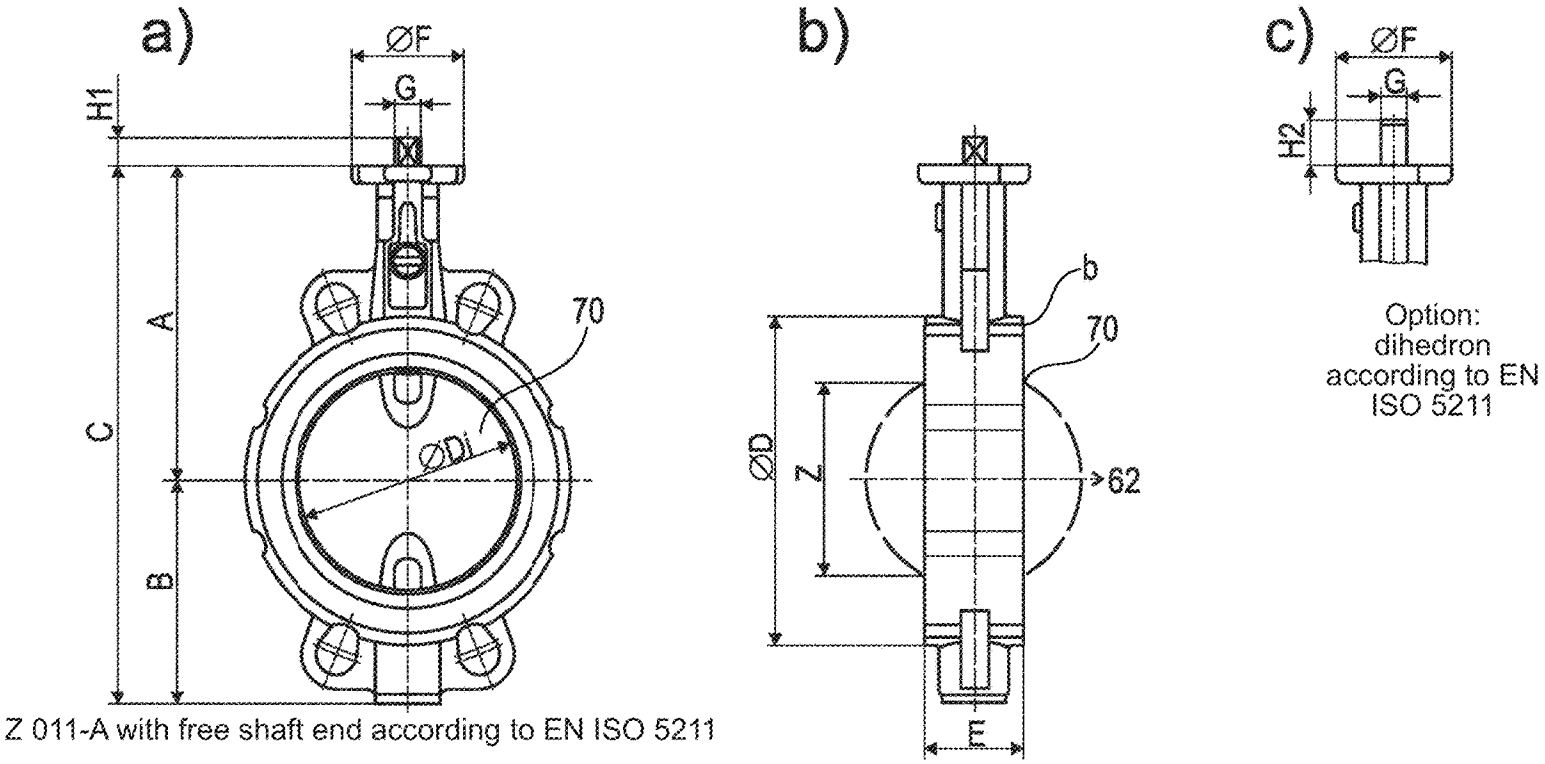
Figure 8:
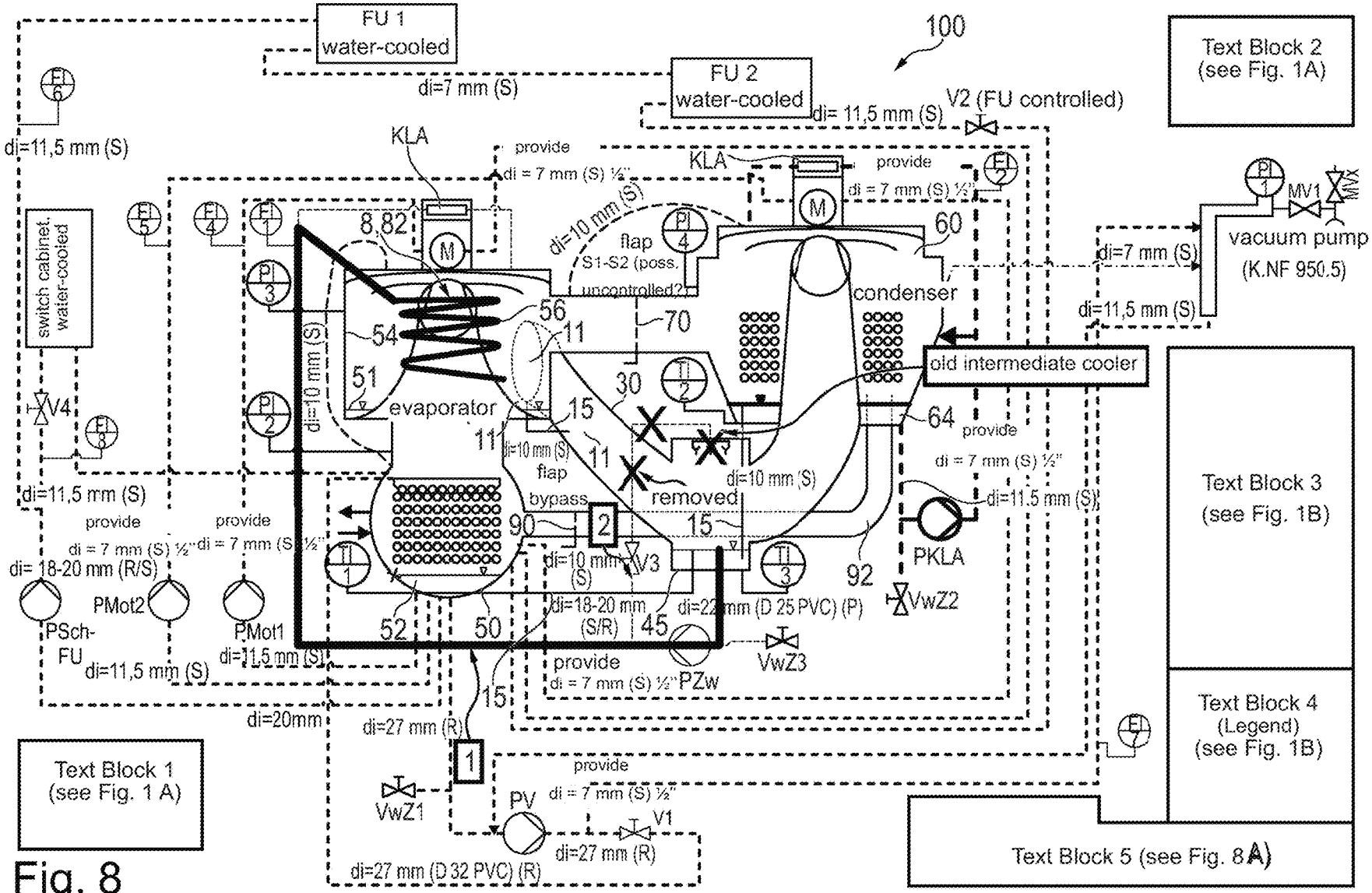
Figure 8A:
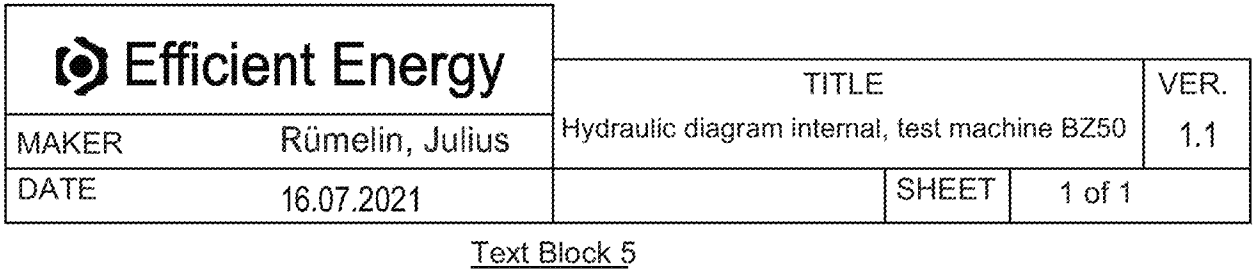
Figure 9:
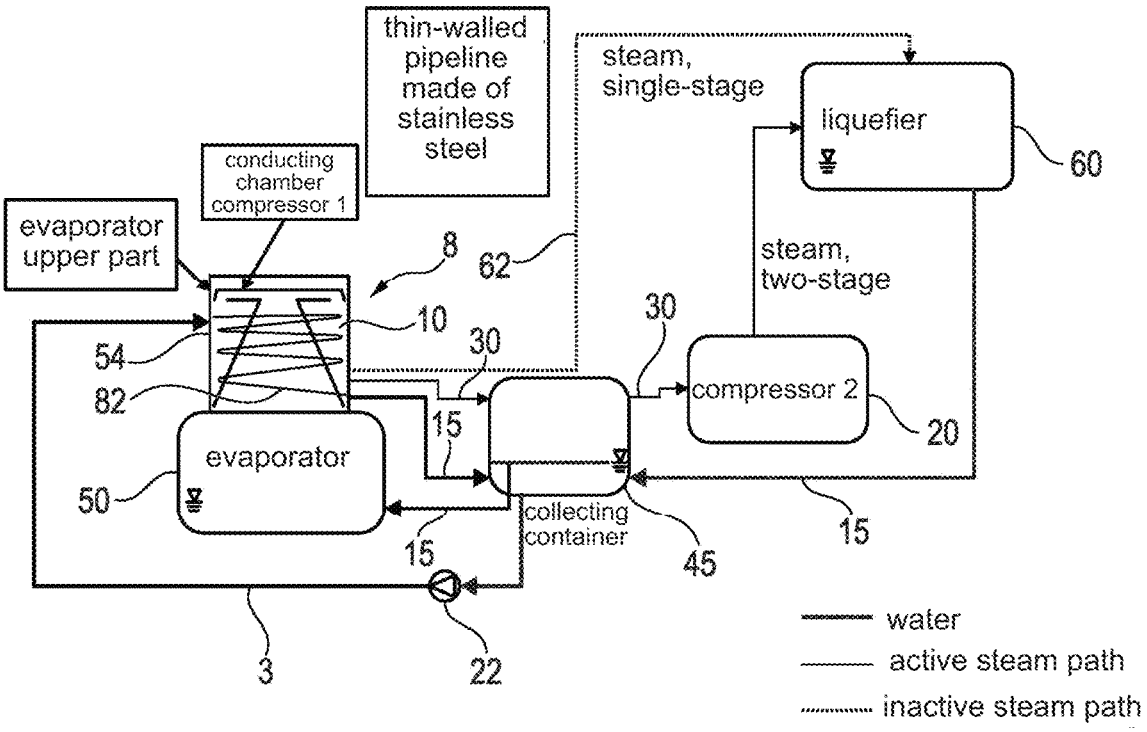
Figure 10:
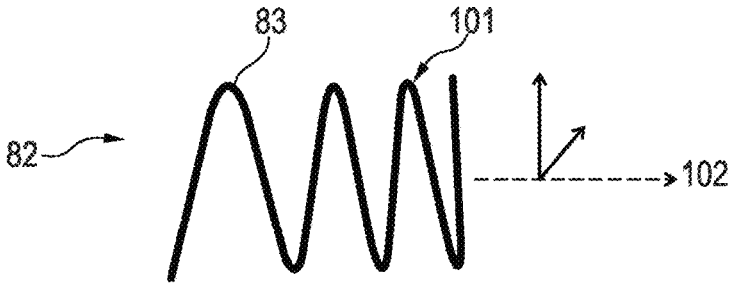
Figure 11:
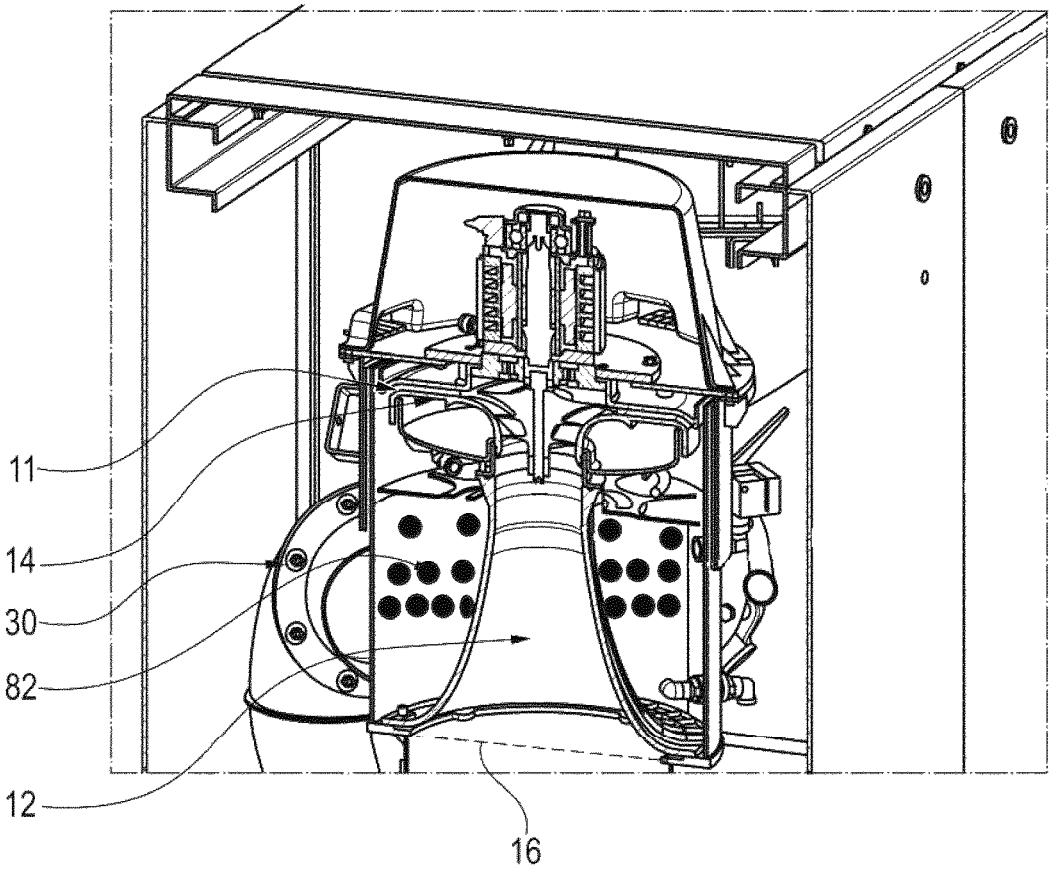
Figure 12:
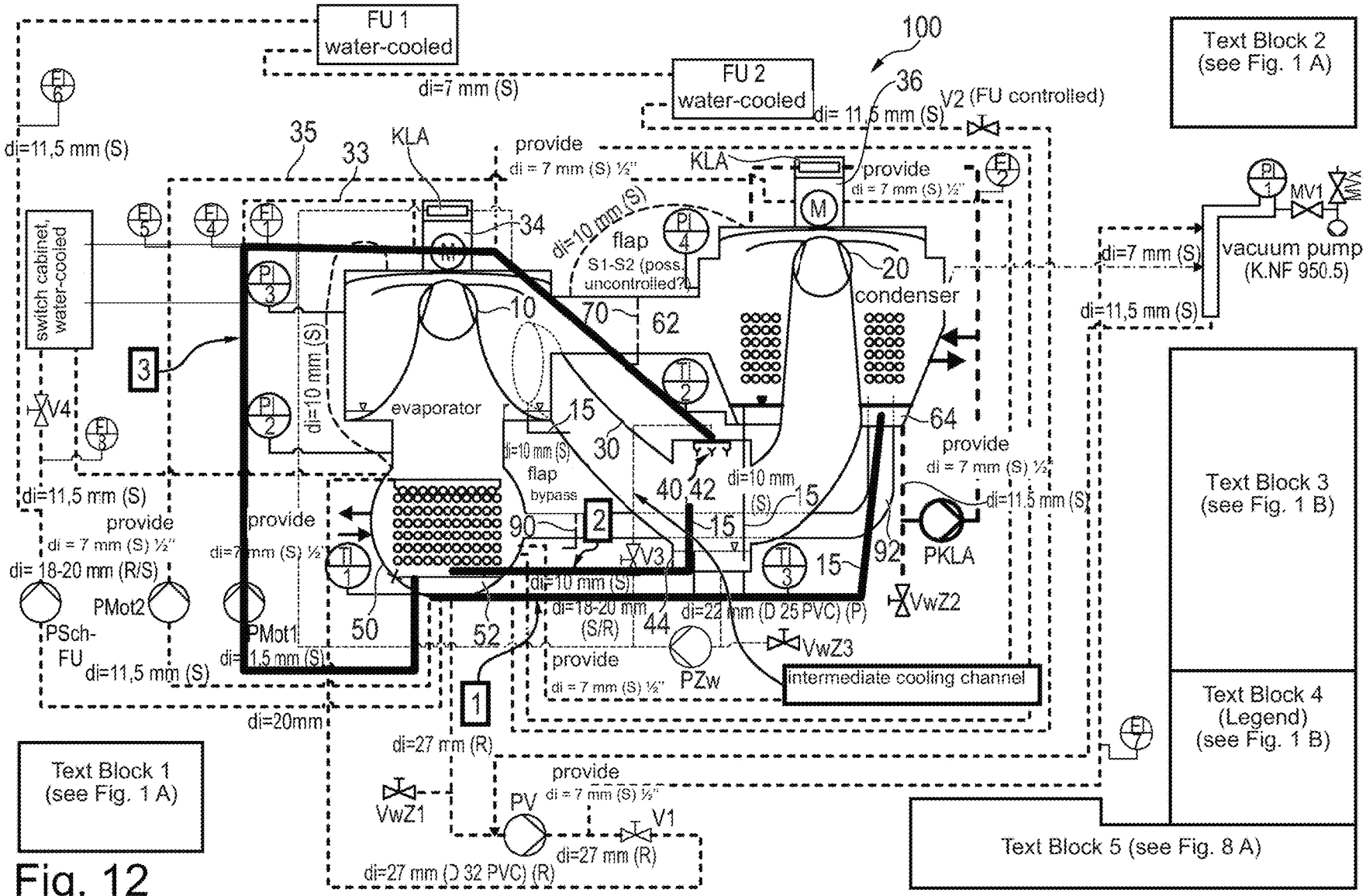
Figure 13:
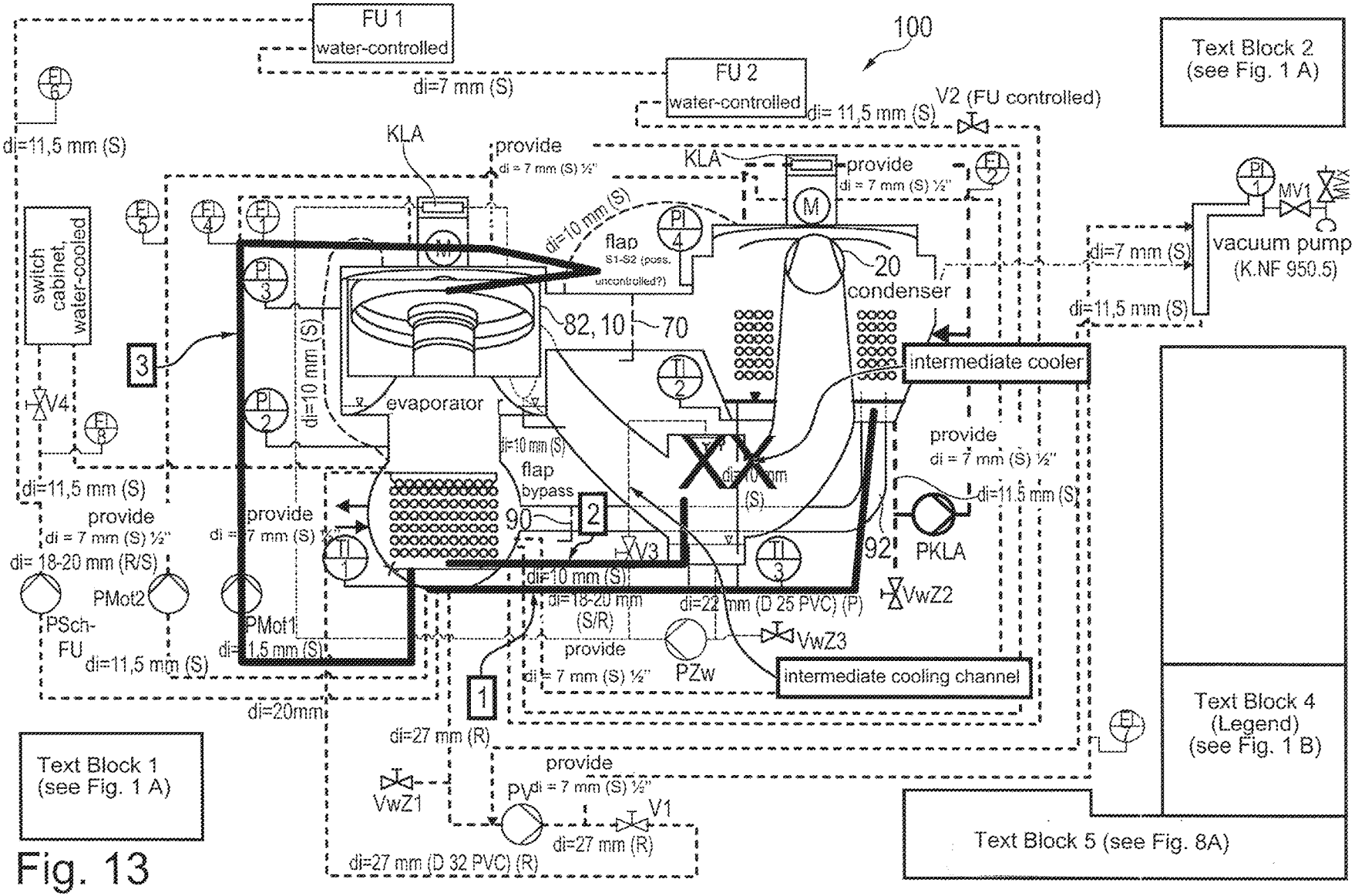
Figure 14:
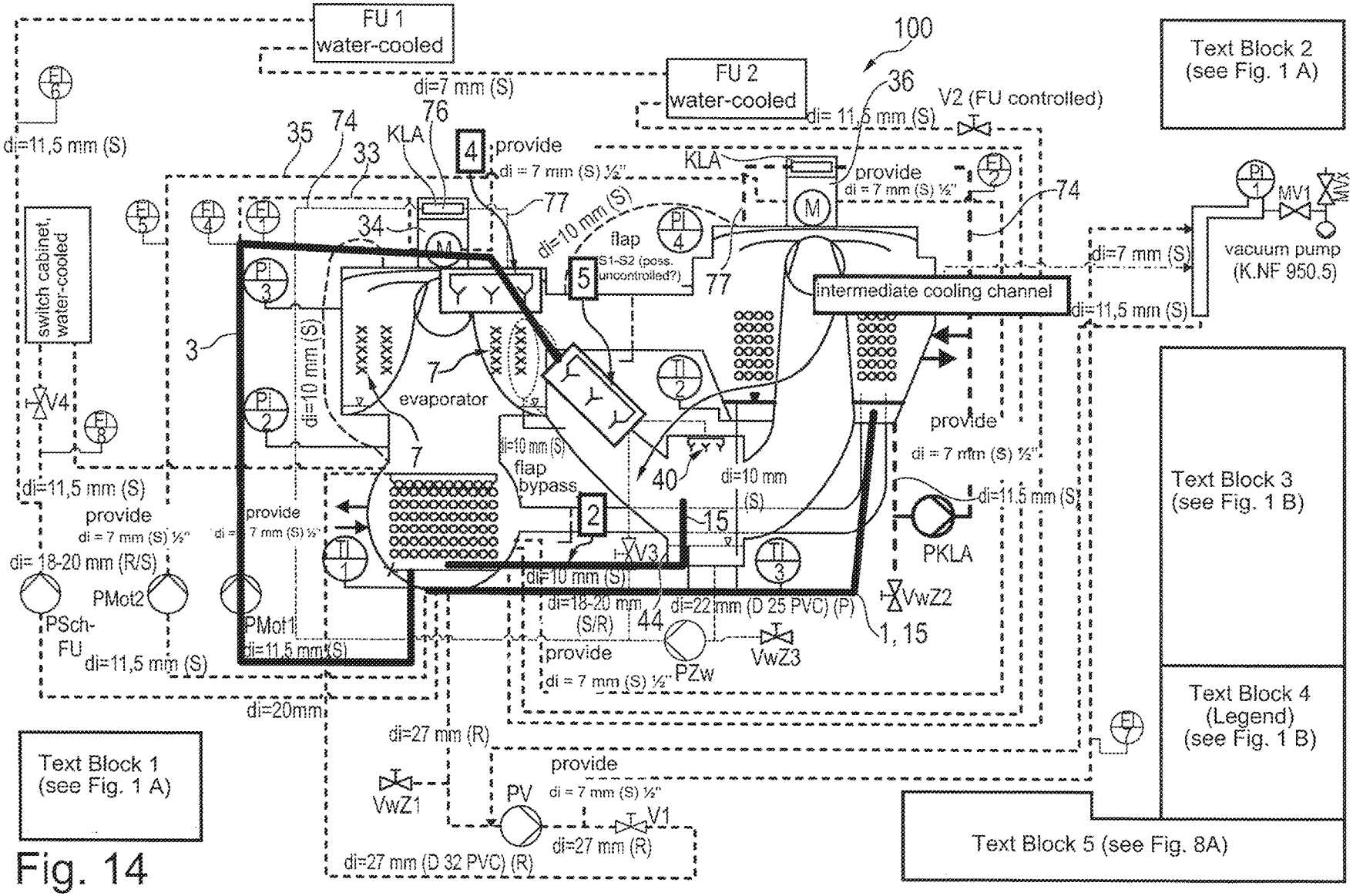
Figure 15:
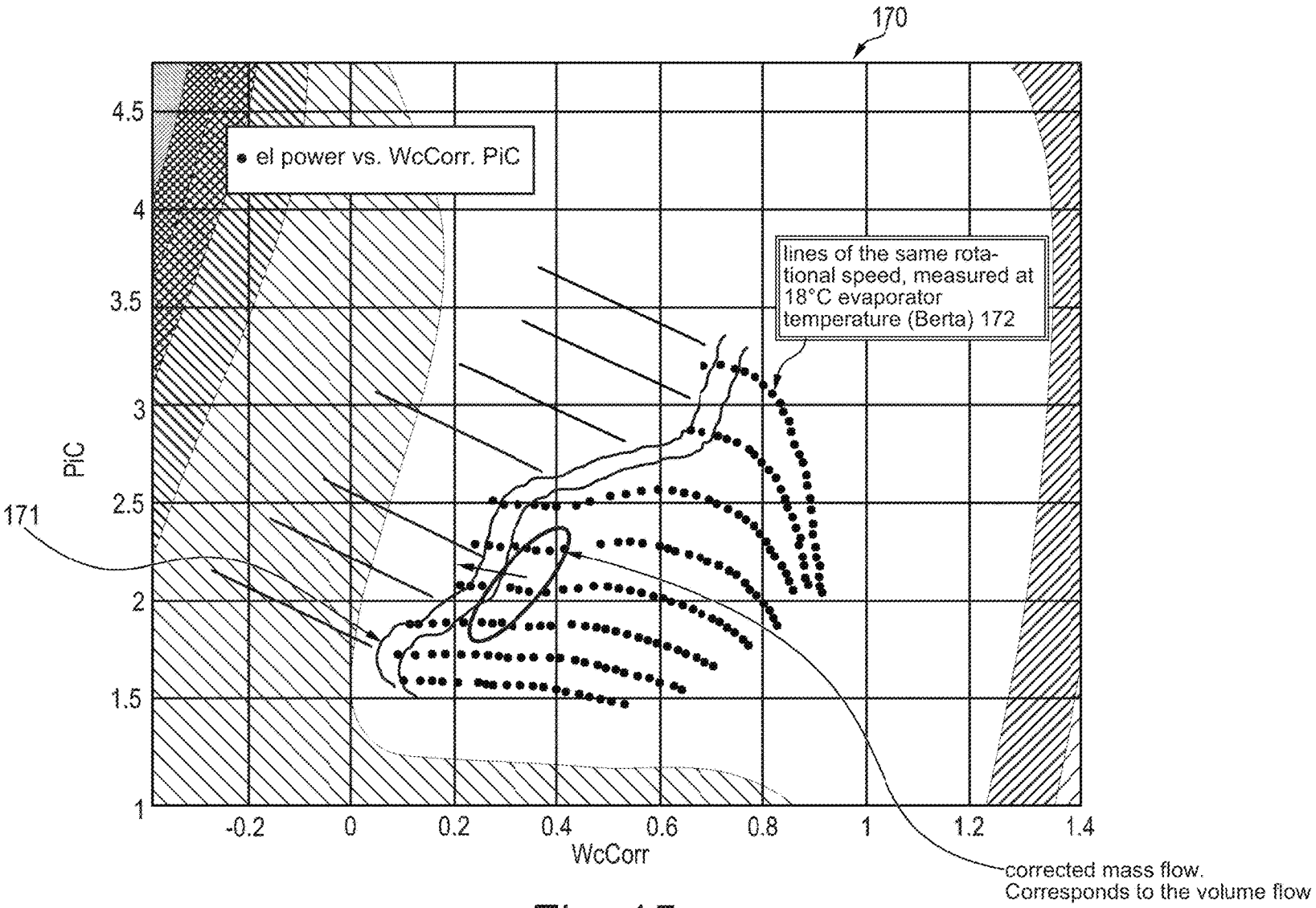
Figure 16:
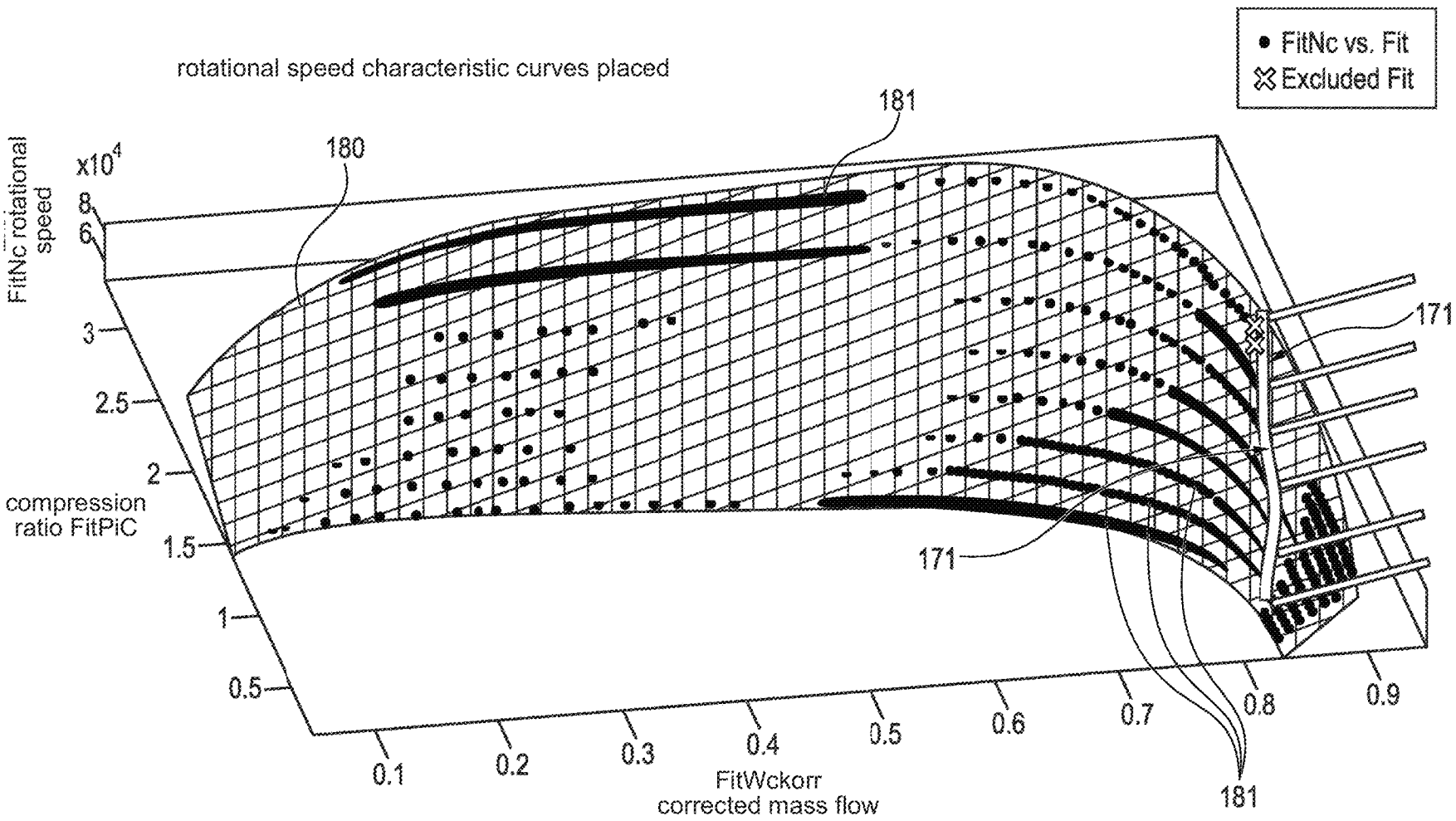
Figure 17:
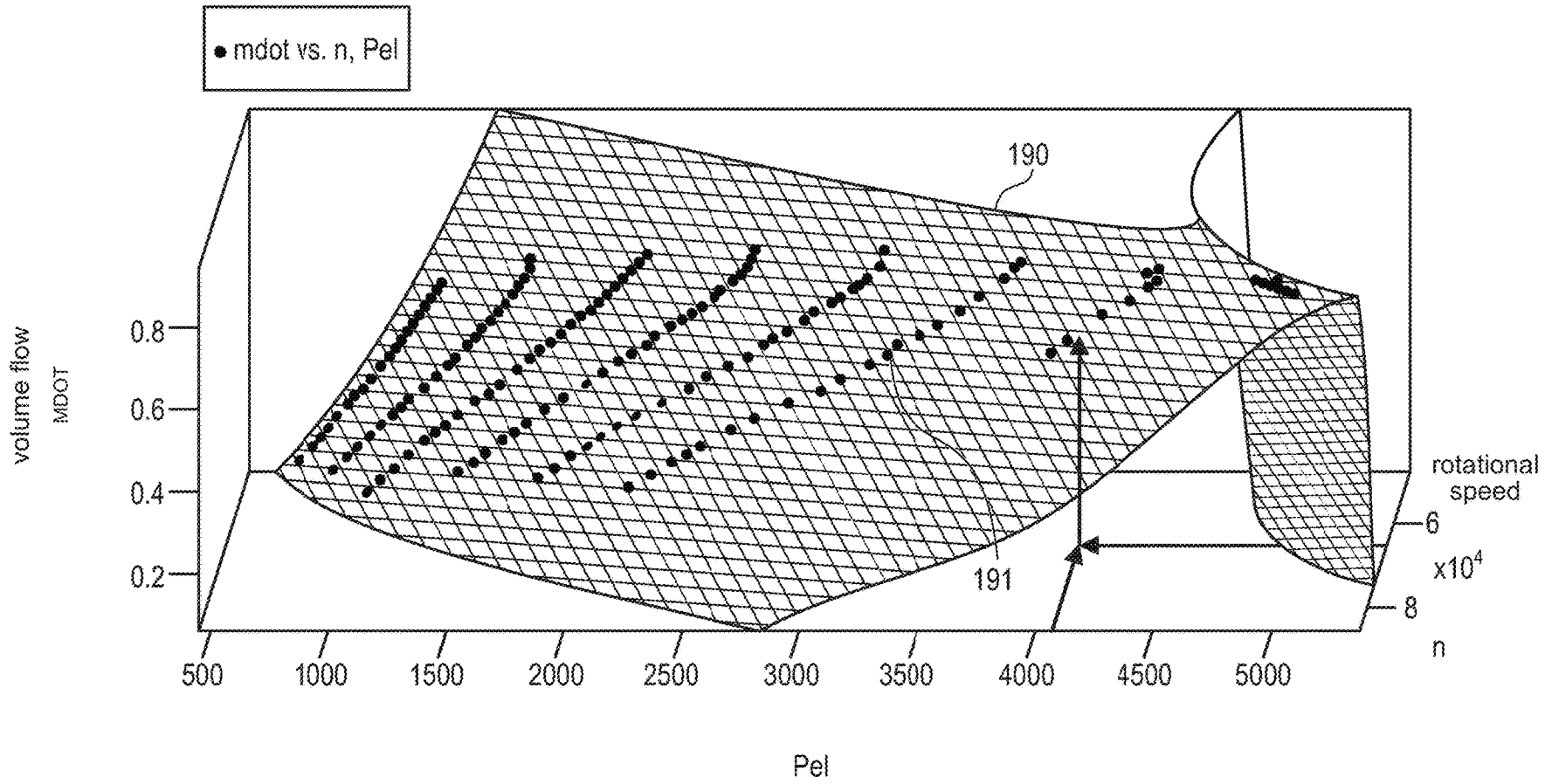
Figure 18:
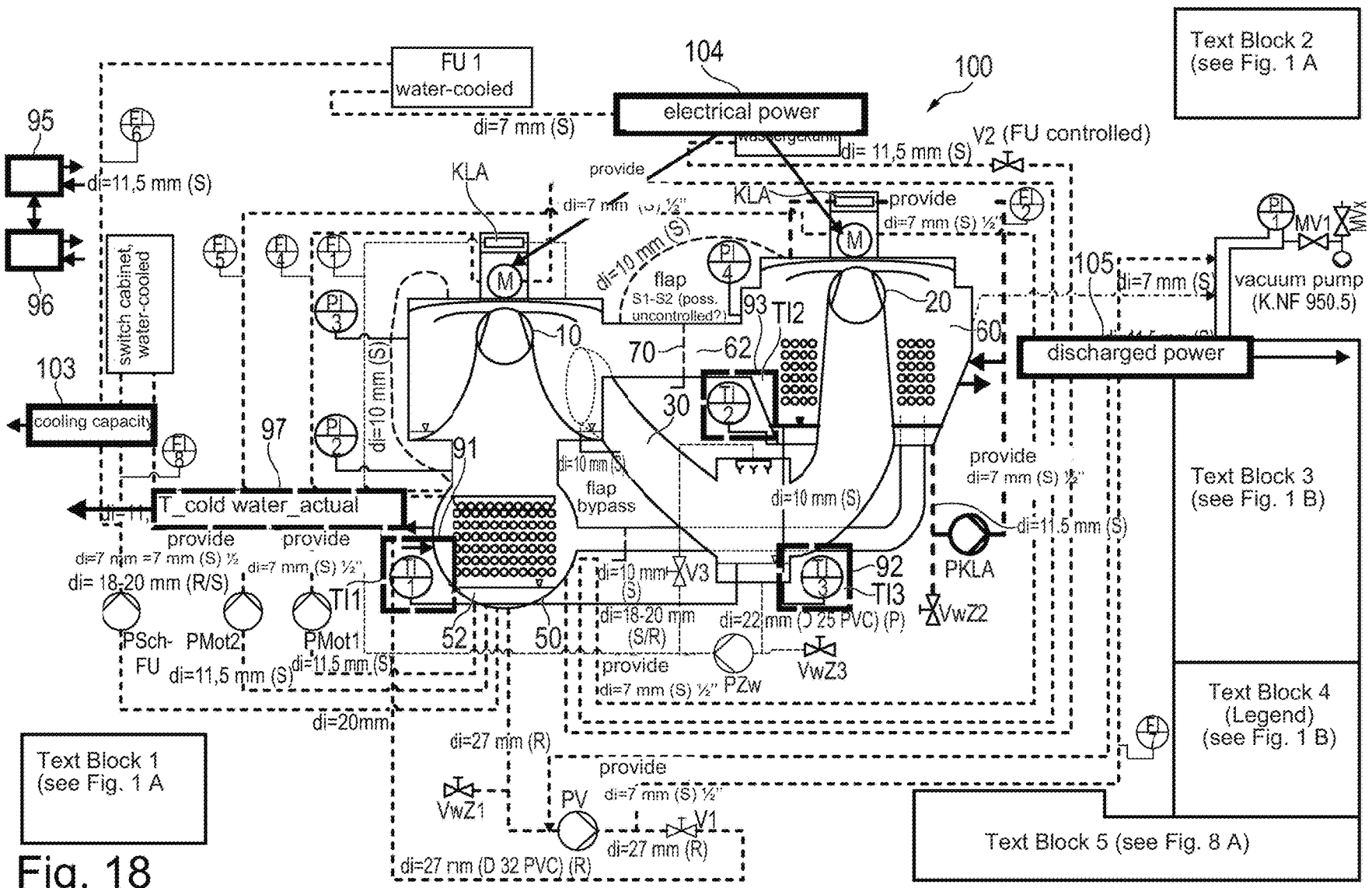
Figure 19:
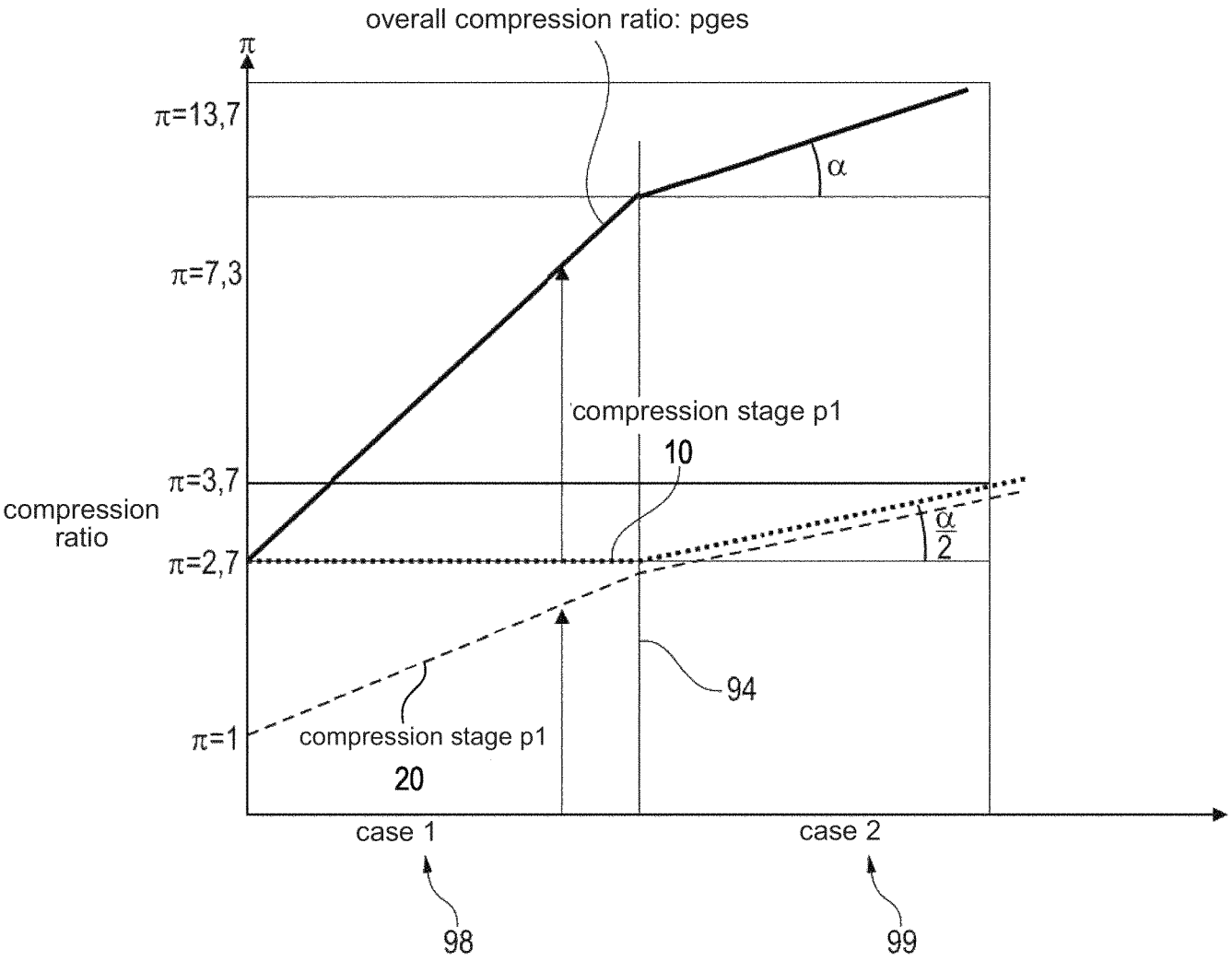

Preferred embodiments of the present invention are explained in detail in the following with reference to the accompanying drawings, in which show:

FIG. 1 a hydraulic diagram of the heat pump according to the invention;

FIG. 2 an enlarged detail from the hydraulic diagram according to FIG. 1, wherein a vapour flap (upper strand) and a vapour bypass flap (lower strand) are drawn;

FIG. 3 a schematic test bench which serves to test the functionality of the compressor of the heat pump under real operating conditions;

FIG. 4 a schematic configuration of an N-stage compression, wherein in the case shown is N=3;

FIG. 5 a hydraulic diagram of the N-stage compression;

FIG. 6 a three-dimensional view of the heat pump according to the invention;

FIG. 7 a plan view (FIG. 7*a*) and a side view (FIG. 7*b*) of the cross-section reducing element and a connection of the cross-section reducing element (FIG. 7*c*);

FIG. 8 a hydraulic diagram in which a circuit of an indirect intermediate cooling stage is shown;

FIG. 9 a hydraulic diagram of the indirect intermediate cooling stage having an indirect heat exchanger;

FIG. 10 a sketch of a side view of a heat exchanger pipe;

FIG. 11 diametrical perspective view of the heat exchanger;

FIG. 12 a hydraulic diagram showing a feed of the intermediate cooling stage, wherein the intermediate cooling stage is fed from the evaporator sump;

FIG. 13 a hydraulic diagram showing a feed of the intermediate cooling stage with a sketched heat exchanger, wherein the intermediate cooling stage is fed from the evaporator sump;

FIG. 14 a hydraulic diagram showing a feed of the intermediate cooling stage with additional filling materials and/or additional intermediate cooling stage, wherein the intermediate cooling stage is fed from the evaporator sump;

FIG. 15 a compressor characteristic diagram;

FIG. 16 shows a three-dimensional enveloping surface over a corrected mass flow;

FIG. 17 a three-dimensional illustration for determining the volume flow for ascertaining the corrected mass flow;

FIG. 18 a hydraulic diagram which highlights temperature sensors for conducting of the second compressor;

FIG. 19 a diagram for illustrating control of the compressor stages of the heat pump;

FIG. 20 a hydraulic diagram of a heat pump known from the prior art; and

Figure 21:
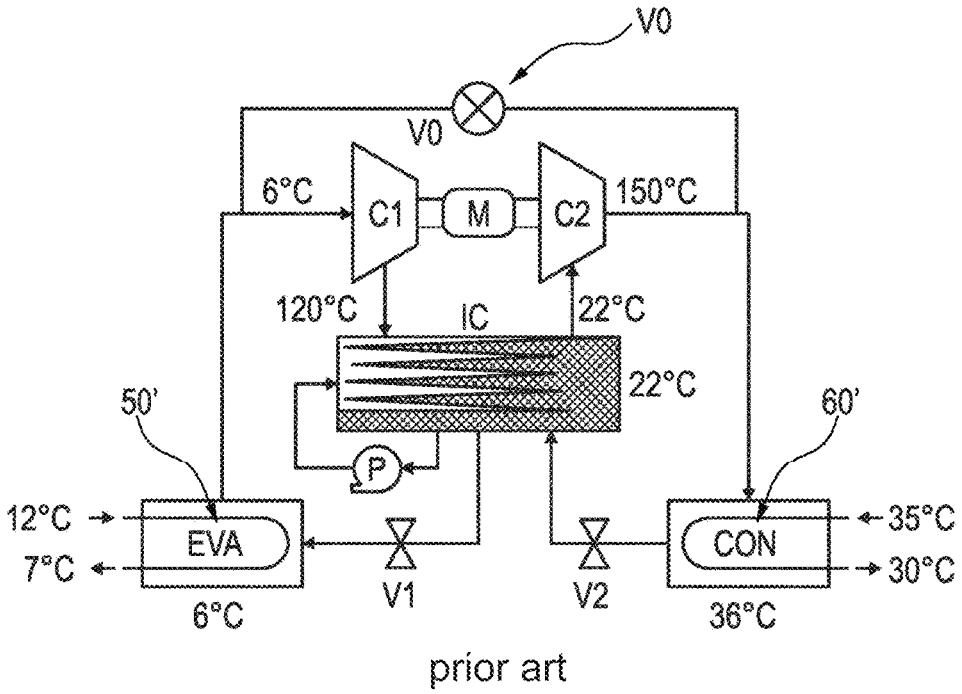

FIG. 21 a hydraulic diagram of a heat pump known from the prior art comprising a vapour bypass.

Individual aspects of the invention described herein are described in the following in FIG. 1 to 15. In the present application, the same reference signs relate to identical or equivalently acting elements, wherein not all reference signs have to be set out again in all the drawings, if they are repeated.

The heat pump 100 according to the invention is described in overview of the accompanying FIG. 1 to 19, wherein individual aspects of the heat pump according to the invention are considered with different facets in the different FIG. 1 to 19, in order to highlight, in overview, the individual aspects of the embodiments of the heat pump according to the invention. The individual aspects of the embodiments can be exchanged with one another as desired.

FIG. 1 shows a hydraulic diagram of the heat pump 100 according to the invention. In the hydraulic diagram according to FIG. 1, a first compressor stage 10 and a second compressor stage 20 are visible. The first compressor stage 10 and the second compressor stage 20 are connected to one another via a vapour duct 30. The vapour duct preferably has a curved shape having a sink 32. In mathematical terms, the vapour duct comprises at least one turning point in the sink 32, wherein in the at least one turning point a curvature is zero. According to the hydraulic diagram according to FIG. 1, an intermediate cooler 40 is arranged in the sink 32. The intermediate cooler 40 comprises an effect element 42 and an intermediate cooler sump 44. The intermediate cooler sump 44 for collecting fluid, and the effect element 42 of the intermediate cooler 40, are coupled together via a first intermediate cooler line 46, wherein fluid can be conducted out of the intermediate cooler sump 44, via the first intermediate cooler line 46, to the effect element 42, in order to sprinkle compressed fluid from the first compressor stage 10, which is in particular conducted in the vapour duct 30 to the second compressor stage 20, for the purpose of cooling. Furthermore, beginning at the intermediate cooler sump 44 a second intermediate cooler line 48 is provided. The second intermediate cooler line 48 leads from the intermediate cooler sump 44 to a ball bearing adapter 49, for cooling the ball bearing adapter 49.

The hydraulic diagram according to FIG. 1 furthermore shows an evaporator 50 assigned to the first compressor stage 10. The evaporator 50 comprises an evaporator sump 52. Above the evaporator sump 52, the evaporator 50 comprises an upper evaporator part 54, in which the first compressor stage 10 is arranged. A pipeline 56 is arranged above the evaporator sump 52, in the evaporator 50, which pipeline is arranged, according to the cross-section, shown, of the hydraulic diagram according to FIG. 1, in a matrix-shaped manner above the evaporator sump 52. Fluid to be cooled can flow through the pipeline 56 above the evaporator sump 52. A sprinkling device 58 is arranged above the pipeline, in order sprinkle the pipeline 56 with fluid from the evaporator sump 52. A first evaporator line 59 is provided from the evaporator sump 52 to the sprinkling device 58, which line conducts fluid from the evaporator sump 52 to the sprinkling device 58. After sprinkling of the pipeline 56, the fluid discharged via the sprinkling device 58 can be collected in the evaporator sump 52 and supplied again to a circuit of the heat pump 100.

The hydraulic diagram according to FIG. 1 furthermore shows a bridging channel 62 arranged between the first compressor stage 10 and a condenser 60, for bridging the second compressor stage 20. After exiting the first compressor stage 10, compressed fluid can be conducted directly to the condenser 60 via the bridging channel 62. The condenser 60 comprises a condenser sump 64 for collecting fluid. A pipeline 56 is arranged above the condenser sump 64. However, the pipeline 56 assigned to the condenser does not comprise a sprinkling device. Fluid to be heated flows through the pipeline 56 assigned to the condenser 60.

Further features of the hydraulic diagram according to FIG. 1 are described in the following in connection with the further advantageous embodiments of the heat pump 100.

FIG. 2 is an enlarged detail from the hydraulic diagram according to FIG. 1, wherein a cross-section reducing element 70 (upper strand) and a vapour transmission flap 90 (lower strand) are illustrated. In an open state of the vapour transmission flap 90, vaporous fluid can be conducted out of the condenser 60 into the evaporator 50 via a vapour-conducting line 92. In an open state of the cross-section reducing element 70, vaporous fluid can be conducted directly to the condenser 60 via the bridging channel 62.

According to a preferred embodiment, the heat pump 100 comprises the evaporator 50 for evaporating a fluid in order to obtain an evaporated fluid, wherein the evaporator 50 comprises the evaporator sump 52. The heat pump 100 further comprises the condenser 60, in order to condense evaporated fluid compressed by an N-stage compressor 10, 80, 20, wherein the condenser 60 has a condenser sump 64, a condensation region 66 and a holding region 67 for holding a vaporous fluid still remaining after the condensation region 66. The N-stage compressor 10, 20, 80 comprises N compressors, wherein N is a natural number greater than or equal to one, wherein the N-stage compressor 10, 20, 80 is arranged between the evaporator 50 and the condenser 60. The heat pump 100 furthermore comprises the vapour duct 30 which couples at least two of the N compressors of the N-stage compressor 10, 20, 80 between the evaporator 50 and the condenser 60. FIG. 4 shows, for example, an N-stage compressor 10, 20, 80, in which is N=3. The heat pump 100 further comprises a vapour-conducting line 92 which is arranged between the condenser 60 and the evaporator 50 in order to conduct vaporous fluid out of the holding region 67 of the condenser 60 into the evaporator 50. FIGS. 2 and 4 show, for example, a single vapour-conducting line 92 in which in each case the vapour transmission flap 90 is arranged.

FIG. 3 shows a schematic testing bench which serves to test the functionality of a single compressor of the heat pump 100 under real operating conditions. According to the testing bench 300 from FIG. 3, is N=1. The testing bench 300 comprises a compressor 301 to be tested and at least one pressure sensor 302 for measuring a compression pressure of the compressed fluid. The testing bench 300 furthermore comprises at least one temperature sensor 303 for measuring the temperature of the compressed fluid. The at least one pressure sensor 302 and the at least one temperature sensor 303 are arranged close to the compressor 301 to be tested. A fluid line 15 leads into the testing bench 300 and a fluid line 15 leads out of it, in order to supply fluid, in particular cooling water, to the pipeline 56 or to discharge it therefrom. The flow in the fluid lines 15 is controlled depending on a liquefaction pressure. The fluid lines 15 of the testing bench 300 are preferably connected to a cold water loop (at approximately 17° degrees water temperature). The testing bench 300 comprises a Jacob pipe which comprises a K4 liquefier. The Jacob pipe is preferably of a height of up to 650 mm, in particular 600 mm, and a diameter of up to 600 mm, in particular 500 mm or 550 mm. Furthermore, the testing bench comprises a further Jacob pipe which is of a height of up to 300 mm, in particular 240 mm, and a diameter of up to 600 mm, in particular 500 mm or 550 mm. The Jacob pipes are arranged on a container 45 in which the fluid assumes a fluid level 51. A temperature sensor 303 for measuring a sump temperature in the container 45 is arranged in the container 45. At least one filling material 7 is arranged above the fluid level 51. The filling material 7 preferably comprises a plurality of individual filling materials which are provided for allowing the vapour to flow past a larger surface, such that it condenses out particularly advantageously. The fluid level 51 is set in the container 45 in such a way that there is a spacing between liquid fluid and the pipe wall, in a pipe 306 which supplies the fluid to the container 45. This spacing forms a vapour passage 304 between the water level and the pipe wall. The pipe 306 establishes a connection between an outlet of the compressor 301 to be tested and an inlet to the container 45, in order to return evaporated fluid from the compressor 301 to be tested into the container 45. The pipe 306 is in particular formed in two parts, wherein a throttle valve 307 is arranged between the two pipe parts, in order to set a resistance of the evaporated fluid. Furthermore, the evaporation temperature is set by means of the throttle valve 307. A connection 311 of the pipe 306 to the compressor 301 to be tested is configured in such a way that different cross-sections of different compressors 301 can be connected to the pipe 306. The testing bench 300 furthermore has a geometric structure which serves as a return 308 of the condensed fluid from the compressor 301 to be tested. Furthermore, an effect element 43 for sprinkling the evaporated fluid is provided in the pipe 306. By means of a pump 310 and an associated line, fluid is pumped out of the container 45 into the effect element 42 of the testing bench 300. The testing bench further comprises a sensor 309, which is in particular a volume flow sensor, in order to measure a volume flow of the evaporated fluid. A connected control device receives the measuring signals of the volume flow sensor and ascertains from this signal inter alia the control signal, in order to specify a target rotational speed for the compressor.

The holding region 67 comprising condensed working fluid is preferably arranged in the condenser 60 between the condensation region 66 and the condenser sump 64. An opening 65 of the vapour-conducting line 92 is arranged in the holding region 67 above a filling level 68, in particular a fluid level 51, of the working fluid in the condenser sump 64. The opening 65 of the vapour-conducting line 92 comprises a channel piece which protrudes through the condenser sump 64 into the holding region 67, in order to conduct evaporated, i.e. non-condensed, fluid via the vapour-conducting line 92 to the evaporator 50.

The condenser sump 64 comprising condensed working fluid is preferably arranged in the condenser 60. The vapour-conducting line 92 extends from the holding region 67 through the condenser sump 64 and is conducted out of the condenser through a wall, preferably a base, of the condenser 60. FIGS. 2 and 4 show, for example, how the vapour-conducting line 92 extends through a base of the condenser sump 64. It is conceivable that the vapour-conducting line 92 may extend through the condenser sump 64 through a wall, in particular a side wall.

The condenser 60 preferably comprises a pipe bundle **56*a* or a helical pipe arrangement 56*b*, through which liquid to be heated can flow, wherein the pipe bundle 56*a* or the helical pipe arrangement 56*b* is arranged laterally with respect to the opening 65 of the vapour-conducting line 92, and wherein an suction manifold 12 of a compressor of the N-stage compressor 10, 20, 80 is arranged above the pipe bundle 56*a* or the helical pipe arrangement 56*b*. In the present case, the pipe bundle 56*a* or the helical pipe arrangement 56*b* are also referred to as a pipeline 56**.

The vapour-conducting line 92 preferably comprises an opening 55 into the evaporator 50 wherein the opening 65 is arranged above the evaporator sump 52, in the evaporator 50. The vapour-conducting line 92 thus comprises two openings 55, 65, wherein one opening leads through the condenser sump 64 and the other opening 55 leads into the evaporator 50 above the evaporator sump 52. This can be derived for example from FIGS. 2 and 4.

Preferably a pipe bundle **56*a* for liquid to be cooled, and a sprinkling device 58 for sprinkling the pipe bundle 56*a*, are arranged in the evaporator 50, wherein the opening 55 of the vapour-conducting line into the evaporator 50 is arranged such that vaporous fluid which enter the evaporator 50 through the opening 55 strikes the pipe bundle 56*a* laterally, and/or that the vaporous fluid which emerges from the vapour-conducting line 92 enters a sprinkling region 57 which is sprinkled at least in part by the sprinkling device 58. As can be seen for example from FIG. 1, 2 or 4, fluid is supplied to the sprinkling device 58 from the evaporator sump 52 via a first evaporator line 59 between the evaporator sump 52, as far as to the sprinkling device 58. After sprinkling of the pipe bundle 56*a* in the evaporator 50, the fluid used for sprinkling can be collected again by the evaporator sump 52 and supplied again to a circuit of the heat pump 100**.

Preferably, each compressor of the N-stage compressor 10, 20, 80 comprises its own shaft, on which the corresponding compressor of the N-stage compressor 10, 20, 80 can be operated and individually actuated during operation. As can be seen for example from FIG. 1, 2 or 4, each compressor comprises its own motor M. The compressors of the N-stage compressor 10, 20, 80 can therefore be operated independently of one another or can individually not be operated at all.

The N-stage compressor 10, 20, 80 preferably comprises N compressors connected in series, wherein the vapour-conducting line 92 is configured as a single vapour-conducting line 92 and conducts the vaporous fluid, brought into the condenser 60 from a last stage, from the condenser 60 into the evaporator 50 (see FIGS. 2, 4 and 5). FIG. 5 is a hydraulic diagram of the N-stages compression. In FIG. 5, the cross-section reducing element 70 is shown configured as a valve for example. The N-stage compressor 10, 20, 80 is shown as N compressors connected in series, which is connected between the evaporator 50 and the condenser 60.

Preferably, at least two compressors of the N-stage compressor 10, 20, 80 are connected via a vapour duct 30 and in each case an intermediate cooler 40 is arranged between two compressors, in order to cool the vaporous fluid (see FIG. 4). Each intermediate cooler 40 comprises an effect element 42 and an intermediate cooler sump 44 (see FIG. 4). The intermediate cooler sump 44, for collecting fluid in each case, and the effect element 42 of the respective intermediate cooler 40, are in each case coupled together via a first intermediate cooler line 46, wherein fluid can be conducted out of the intermediate cooler sump 44, via the first intermediate cooler line 46, to the effect element 42. After passing through the respective effect element 42, the fluid can be collected by the intermediate cooler sump 44. The fluid can then be supplied again to a circuit of the heat pump 100. In FIG. 5 showing an intermediate cooler 40 in each case between the compressors of the N-stage compressor 10, 20, 80 has been omitted for the sake of clarity.

The intermediate cooler 40 is preferably arranged in a sink 32 of the vapour duct 32 and the intermediate cooler 40 comprises an intermediate cooling sump 44 and an effect element 42, wherein the effect element 42 is configured to bring about an interaction between an intermediate cooling fluid that can flow through a supply line, in particular the first intermediate cooler line 46, from the intermediate cooling sump 44 or from the evaporator sump 52 or from the condenser sump 64 into the effect element 42, and a heated vaporous fluid that can be output from the compressor, wherein the interaction in particular brings about cooling of the vaporous fluid, discharged from the compressor, by the intermediate cooling fluid (see FIGS. 2 and 4). Before the vaporous fluid in the vapour duct 30 is suctioned by the second compressor stage 20, the vaporous fluid is cooled by the intermediate cooler 40.

Preferably, each intermediate cooler 40 comprises an intermediate cooling sump 44 and an effect element 42 and is arranged in its own sink 32 in the vapour duct 30, in particular each intermediate cooler 40 comprises its own first intermediate cooler line 46 to the effect element 42. The first intermediate cooler line 46 can also be referred to as a supply line. In particular in the case of a plurality of intermediate cooling sumps 44, the supply lines, i.e. the first intermediate cooler lines 46, can also be connected to one another (not shown in the figures), such that the supply lines then form just one supply line overall.

The vapour duct 30 preferably has a curved shape, comprising the sink 32, between two compressors, such that fluid from the vapour duct 30 flows past the intermediate cooling sump 44. Condensed fluid can be collected in the intermediate cooling sump 44.

Preferably, the vapour-conducting line 92 and the vapour duct 30 are fluidically separated from one another. In the present case, fluidically separated from one another means that the vapour-conducting line 92 and the vapour duct 30 do not merge into one another, which would allow mixing of the fluid. Therefore, the vapour-conducting line 92 and the vapour duct 30 are shown for example by dashed lines in FIGS. 2 and 4, in order to show that the vapour-conducting line 92 and the vapour duct 30 are separated from one another. Of course, the vapour-conducting line 92 and the vapour duct 30 form a circuit, in which the fluid circulates in the heat pump 100. The vapour duct 30 or the vapour ducts 30 is/are arranged between the evaporator 50 and the condenser 60, in the upper strand. The vapour-conducting line 92 is arranged between the evaporator 50 and the condenser 60, in the lower strand.

Preferably, further N compressors are arranged such that a further compressor of the N compressors is connected in series with a first compressor of the N-stage compressor 10, 20, 80, by switching a switch into an open state. In FIG. 5, n+1 compressors are shown schematically to the first compressor 10. The n+1 compressor is shown in dashed lines, which is intended to indicate the switching in of the individual compressors of the N-stage compressor 10, 20, 80. In the present case, the first compressor stage 10 comprises the first compressor. The second compressor stage comprises the second compressor. An n-th compressor stage comprises an n-th compressor, wherein n is a natural number.

A bridging flap 90 is preferably arranged in the vapour-conducting line 92, which flap can be transferred into an open position for conducting the vaporous fluid from the condenser 60 to the evaporator 50, an intermediate position, or into a closed position for preventing conduction of the vaporous fluid into the evaporator. Similarly to the cross-section reducing element 70, the bridging flap 90 can be configured as a orifice or a leaf door or a check valve, or as a valve as is shown for example in FIG. 5. The heat pump 100 further comprises a controller for controlling the bridging flap 90 into the open position, into the intermediate position, or into the closed position.

The bridging flap 90 is preferably configured as a controlled bridging valve which can be addressed by means of the controller in order to be operated close to a boundary line of a compressor characteristic diagram 170 assigned to the N-stage compressor 10, 20, 80. The configuration of the bridging flap 90 as a controlled bridging valve is shown for example in FIG. 5. In the present case, the bridging flap 90 can also be referred to as a vapour transmission flap 90.

A compressor characteristic diagram 170 assigned to the N-stage compressor 10, 20, 80 defines a relationship between a pressure ratio and a mass flow. A compressor characteristic diagram 170 of this kind is shown for example in FIG. 15. The compressor characteristic diagram 170 is to be understood as a three-dimensional field, wherein the third dimension is shown by shading in the two-dimensional coordinate system, which is spanned by the pressure ratio PiC and the, in particular corrected, mass flow WcCorr. The pressure ratio PiC describes a ratio of the pressures between the evaporator 50 and the condenser 60, i.e. between the compressor stages 10, 20, 80. A pump limit 171 is present in the compressor characteristic diagram 170, which represents a monotonically increasing function between the mass flow and the pressure ratio. The bridging flap 90 is controlled in order to ensure that, for a particular mass flow, the pressure ratio is smaller than a limit pressure ratio which, according to the function, is assigned to the particular mass flow. In FIG. 15, the dotted lines 172 represent lines of identical rotational speed at a measured evaporation temperature of 18° degrees.

The controller is preferably configured to transfer the bridging flap 90 into a closed position, into an open position, or into an intermediate position, in order to hold a load of the N-stage compressor 10, 20, 80 at least at a load target value, during operation. The pump limit 171 can in particular describe the load target value, which can in particular also be a function depending on the mass flow WcCorr. In particular, the controller is configured to actuate the bridging flap 90 in such a way that operation of the heat pump 100 takes place substantially along the pump limit 171 or in a region shifted slightly to larger mass flows WcCorr, such that operation of the compressor below its absorption limit is advantageously prevented.

The controller is preferably configured to open the bridging flap 90 if the load of the N-stage compressor 10, 20, 80 falls below the load target value; or to close the bridging flap 90 if the load of the N-stage compressor 10, 20, 80 exceeds the load target value, in order to create an additional load; or to control the intermediate position of the bridging flap 90 depending on falling below the load target value. This makes it possible for the heat pump to be operated substantially along the pump limit 171. For example, the bridging flap 90 can be transferred into the intermediate position if the load of the N-stage compressor 10, 20, 80 deviates from the load target value by up to 5%. This can take place beginning from the open or from the closed position of the bridging flap 90. The load target value specifies a load of the heat pump 100 during operation, which is to be achieved at least by the N-stage compressor 10, 20, 80.

Preferably, in the case of a two-stage compressor 10, 20, as is shown for example in FIG. 2, the second compressor is deactivated when the bridging flap 90 is opened, or, in the case of a multi-stage compressor (as shown for example in FIG. 4 or 5), all stages apart from a first stage 10 are deactivated when the bridging flap 90 is opened. Thus, as soon as all compressor stages apart from one are deactivated, the bridging flap 90 is opened. If at least one further compressor stage, in addition to the compressor stage already in operation, is deactivated, the bridging flap 90 is closed or optionally transferred into an intermediate position. For example, the first compressor 10 can be controlled depending on a rotational speed of a compressor drive, in order to adjust the rotational speed of the first compressor stage 10 to a required power of the first compressor 10.

FIG. 6 is a three-dimensional view of the heat pump 100 according to the invention. The heat pump 100 comprises the first compressor stage 10 and the second compressor stage 20. The first compressor stage 10 and the second compressor stage 20 are connected to one another via the curved vapour duct 30, wherein the vapour duct 30 comprises the intermediate cooler 40. It can furthermore be seen from the view of FIG. 6 that the first compressor stage 10 is connected to the condenser 60 via the bridging channel 62, wherein the cross-section reducing element 70 is arranged in the bridging channel 62. The heat pump 100 was also already described with reference to FIG. 1. According to the view of FIG. 6, not all the details are visible which are disclosed for example by the hydraulic diagram according to FIG. 1. However, the size ratios can be seen from the heat pump 100 shown in FIG. 6; so for example, the vapour duct 30 has an average diameter which corresponds to approximately half the width of the condenser. In this respect, with regard to the description of FIG. 6 reference is also made to the description for FIG. 1 or another figure which shows a hydraulic diagram of the heat pump 100 according to the invention.

A preferred embodiment of the heat pump 100 comprises an evaporator 50 for evaporating a fluid in order to obtain evaporated fluid. The heat pump 100 further comprises a condenser 60 for condensing a compressed fluid. Furthermore, the heat pump 100 comprises a compressor having a first compressor stage 10 and a second compressor stage 20, wherein the compressor is arranged in the flow direction of the evaporated fluid, during operation of the heat pump 100, between the evaporator 50 and the condenser 60, and is configured to compress the evaporated fluid in order to obtain compressed fluid. It is proposed for a bridging channel 62 to be arranged between the first compressor stage 10 and the condenser 60, in order to bridge the second compressor stage 20, wherein a cross-section reducing element 70 is arranged in the bridging channel 62 in order to set a cross-section of the bridging channel 62 for controlling a through-flow of compressed fluid out of the first compressor stage 10 to the condenser 60. After exiting the first compressor stage 100, compressed fluid can thus be conducted directly to the condenser 60, provided that the cross-section reducing element 70 assumes an open position. In particular when the second compressor stage 20 is not in operation, i.e. is in a deactivated state, the cross-section reducing element 70 is in the open position.

The first compressor stage 10 and the second compressor stage 20 are preferably connected via the vapour duct 30 (see also description relating to FIG. 1). The vapour duct 30 is configured to be curved, in particular in a banana shape, i.e. bent. The vapour duct 30 can comprise a sink 32 in which a container 45, or also referred to as an intermediate cooler sump 44, is arranged, in order to collect fluid passing through the vapour duct 30, provided that the gaseous fluid passing through the vapour duct 30 condenses. Since the container 45 is arranged in the sink 32, condensed fluid can be conducted into the container 45 automatically, in particular without further technical means, by making use of the gravitational force.

The bridging channel 62 preferably comprises an opening into the first compressor stage 10, wherein the first compressor stage 10 comprises an suction manifold 12 for suctioning the evaporated fluid, and a conducting chamber 14 for conducting the vaporous compressed fluid into the bridging channel 62. The suction manifold 12 can be cone-shaped, wherein a first diameter is arranged in a suction region of the suction manifold 12 for suctioning the fluid, and a second diameter of the suction manifold 12 directly adjoins the conducting chamber 14. In particular, the first diameter is larger than the second diameter. In the present case, the first diameter is a maximum diameter 16 and the second diameter is a minimum diameter 17. The conducting chamber 14 is arranged transversely, in particular substantially orthogonally, to the second diameter of the suction manifold 12.

The condenser 60 preferably comprises a pipeline 56. The pipeline 56 is preferably configured as a pipe bundle **56*a* or a helical pipe arrangement 56*b*, through which liquid to be heated can flow, wherein the pipe bundle 56*a* or the helical pipe arrangement 56*b* is arranged laterally with respect to a further opening of the bridging channel 62, and wherein a suction manifold 12 of a compressor of the second compressor stage 20 is arranged above the pipe bundle 56*a* or the helical pipe arrangement 56*b***.

The further opening of the bridging channel 62 is preferably arranged such that vaporous fluid which enters the condenser 60 through the further opening strikes the pipe bundle 56 laterally. Since the pipeline 56, i.e. the pipe bundle **56*a* or the helical pipe arrangement 56*b*, is arranged laterally with respect to a further opening of the bridging channel 62, in the condenser 60, evaporated compressed fluid, after passing through the bridging channel 62, directly strikes the pipeline 56, at which the evaporated and compressed fluid can be cooled. Since fluid to be heated can flow through the pipeline 56, a heat transfer occurs from the evaporated and compressed fluid, which strikes the pipeline 56 laterally from the bridging channel 62, via the pipeline 56, to the fluid to be heated which flows through the pipeline. When the evaporated and compressed fluid strikes the pipeline 56, the evaporated and compressed fluid is cooled, such that condensation may occur. A fluid condensed on the pipeline 56 may, in particular due to gravity, drip into the condenser sump 64**.

The cross-section reducing element 70 is preferably configured to assume a closed position or an open position, depending on the operation of the second compressor stage 20, wherein the cross-section reducing element 70 is configured to assume the closed position when the second compressor stage 20 is activated, or to assume the open position when the second compressor stage 20 is deactivated. Depending on the operation of the second compressor stage 20, the cross-section reducing element 70 can be transferred into the closed or the open position. It is furthermore conceivable to transfer the cross-section reducing element 70 into an intermediate position, i.e. a position between the open and the closed position, in particular then, when the second compressor stage 20 is shut down (deactivated) or started up (activated).

The cross-section reducing element 70 is preferably pretensioned by means of a spring element (not shown) in the closed position. If the second compressor stage 20 is deactivated, the pretensioned spring element can relax, in particular due to failure of suctioning of compressed fluid of the first compressor stage 10 through the vapour duct 30, such that the cross-section reducing element 70 transitions into the open position. The compressed fluid from the first compressor stage 10 can thereupon pass through the bridging channel 62, as a result of which the second compressor stage 20 is bridged.

The cross-section reducing element 70 is preferably a flap or an orifice or a leaf door or a check valve. FIG. 7 shows, in FIG. 7*a*, a plan view of the cross-section reducing element 70 and, in FIG. 7*b*, a side view of the cross-section reducing element 70. The cross-section reducing element 70 is arranged in the bridging channel 62, between an outlet of the first compressor stage 10 and the condenser 60 (see for example FIG. 1, FIG. 2 or FIG. 4). A diameter 72 of the cross-section reducing element 70 (as shown in FIG. 7*a*) may correspond to a diameter of the bridging channel 62 or may be smaller than the diameter of the bridging channel 62. The diameter of the bridging channel 62 may be for example 10 mm. Of course, the diameter of the bridging channel 62 may also be a different diameter. In the side view of the cross-section reducing element 70 (as shown in FIG. 7*b*), the diameter 72 of the cross-section reducing element 70 is smaller than the diameter of the bridging channel 62. FIG. 7*c* shows a detail from FIG. 7*b* with regard to a connection of the cross-section reducing element 70 for controlling the cross-section reducing element 70 into the open or closed position. Further requirements for the cross-section reducing element 70 can be derived for example from DIN EN ISO 5211.

The heat pump 100 preferably comprises a controller for controlling the cross-section reducing element 70 into the open position or the closed position. Depending on the configuration of the cross-section reducing element 70 as a flap or orifice or leaf door or check valve, the controller is configured to actuate the flap or orifice or leaf door or check valve. In the configuration as a orifice, for example, the controller is configured to increase or reduce a diameter of the orifice.

Preferably, the first compressor stage 10 is configured to build up a maximum achievable pressure, and the cross-section reducing element 70 is configured to assume the open position when a pressure ratio between the condenser pressure $TI_2$ and the evaporator pressure $TI_1$ is smaller than the maximum achievable pressure of the first compressor stage, in order to conduct compressed fluid out of the first compressor stage 10, via the bridging channel 62, to the condenser 60. The pressure ratio between the condenser pressure $TI_2$ and the evaporator pressure $TI_1$ can be calculated for example by measuring temperatures. In particular, the temperature $TI_1$ in the evaporator sump 52 and the temperature $TI_2$ in the condenser sump 64 can be measured in each case, in order to determine therefrom the pressure ratio between the condenser pressure ($TI_2$) and the evaporator pressure $TI_1$. In the present case, the measured temperature $TI_1$ in the evaporator sump 52 is associated with the evaporator pressure $TI_1$. In the present case, furthermore the measured temperature $TI_2$ in the condenser sump 64 is associated with the condenser pressure $TI_2$. Therefore, the corresponding measured temperature reference signs $TI_1$ and $TI_2$ are used for the respective pressure in the condenser sump 64 and respectively in the evaporator sump 52. FIG. 18 shows, for example, where the temperatures $TI_1$, $TI_2$ are measured.

Preferably, the cross-section reducing element 70 is configured to assume the closed position when the pressure ratio between the condenser pressure $TI_2$ and the evaporator pressure $TI_1$ is greater than the maximum achievable pressure of the first compressor stage 10, in order to conduct compressed fluid out of the first compressor stage 10, via the vapour duct 30, to the second compressor stage 20. Having arrived in the second compressor stage 20, the compressed fluid is compressed further, before it is supplied to the condenser 60 via a conducting chamber 14. The conducting chamber 14, which is assigned to the condenser 60, is configured analogously to the conducting chamber 14, which is assigned to the evaporator 50 in the upper evaporator upper part 54.

The first compressor stage 10 is preferably operable with N further compressor stages, wherein N is a natural number greater than or equal to two. FIG. 4 shows, for example, three compressor stages 10, 20, 80. According to the illustration in FIG. 4, N is equal to three here. It is conceivable to provide any number of compressor stages between the evaporator 50 and the condenser 60. Preferably, the first compressor stage 10 and the N further compressor stages 80, 30 are arranged in a series connection, wherein in the case of N compressor stages two neighbouring compressor stages are in each case connected via a vapour duct 30 (see FIG. 4, where N=3 is shown, or FIG. 5).

FIG. 8 shows a hydraulic diagram according to FIG. 1, in which a circuit of an indirect intermediate cooling 8 is shown. The indirect intermediate cooling 8 is used in a preferred embodiment of the heat pump 100.

In the preferred embodiment of the heat pump 100, as is shown in FIG. 8, the heat pump 100 comprises the evaporator 50 for evaporating a fluid in order to obtain an evaporated fluid, wherein the evaporator 50 comprises the evaporator sump 52. The heat pump 100 further comprises a condenser 60 for condensing a compressed fluid, wherein the condenser 60 comprises the condenser sump 64. The heat pump 100 further comprises the compressor having the first compressor stage 10 and the second compressor stage 20, wherein the compressor is arranged in the flow direction of the evaporated fluid, during operation of the heat pump 100, between the evaporator 50 and the condenser 60, and is configured to compress the evaporated fluid in order to obtain the compressed fluid. As shown in FIG. 8, the heat pump further comprises a container 45 for collecting an intermediate cooling fluid. The container 45 is in particular an intermediate cooling sump 44. The heat pump further comprises a heat exchanger 82 having a pipeline 56, which is configured for the intermediate cooling fluid to flow through from the container 45, wherein the pipeline 56 is arranged in a flow region 11 between the first compressor stage 10 and the second compressor stage 20, in order to cool vaporous fluid in the flow region 11. FIG. 8 shows, for example, that the heat exchanger 82 is arranged around an suction manifold 12 of the first compressor stage 10. In other words, according to the embodiment according to FIG. 8 the pipeline 56 is arranged in the region of the first compressor stage 10. As shown in FIG. 14, the heat exchanger 82 can be arranged for indirect cooling between the first compressor stage 10 and the second compressor stage 20, in particular there, where an intermediate cooler 40 and/or a further intermediate cooler 4 and/or a still further intermediate cooler 5 can be provided.

The pipeline 56 is preferably made of metal; the pipeline 56 preferably comprises stainless steel and/or copper. The metal pipeline 56 improves a heat transfer between fluid inside the pipeline 56 and fluid outside the pipeline 56.

The pipeline 56 of the heat exchanger 82 is shown for example in FIG. 8 to 10. The pipeline 56 of the heat exchanger 82 preferably comprises a region in which the pipeline 56 extends in a helical or spring-shaped manner, wherein the region that extends in a spring-shaped or helical manner comprises windings 83 having different winding spacings. In the case of a pipeline 56 extending in a spring-shaped manner, a diameter from one winding to the next is constant. In the case of a pipeline 56 extending in a helical manner, a diameter of a winding is of a different size from the diameter of a following winding. A pipeline 56 extending in a helical manner can be configured as conical spiral. A pipeline 56 extending in a spring-shaped manner results in the case of a central projection of a helical line 101 on a plane perpendicular to the helix axis 102, as is shown for example in FIG. 10. FIG. 10 schematically shows the heat exchanger 82.

The first compressor stage 10 preferably comprises an suction manifold 12 for suctioning the evaporated fluid, and a conducting chamber 14 for conducting the vaporous fluid into the flow region 11. The flow region 11 has a volume of an upper evaporator part 54, the vapour duct 30, and also the bridging channel 62. The flow region 11 comprises those regions of the heat pump 100 into which evaporated and compressed fluid can flow.

As is shown for example in FIGS. 8 and 9, the pipeline 56 of the heat exchanger 82 is arranged around the suction manifold 12 of the first compressor stage 10, wherein a winding spacing between two windings 83 in an inflow region of the vaporous fluid of the first compressor stage 10 is larger than in an outflow region of the vaporous fluid into the conducting chamber 14. This can be seen, for example, in FIGS. 8 and 9. Thus that the winding spacing between two windings 83 is greater in an inflow region, the flow speed of the vapour is braked slightly. The winding spacing between two windings 83 in the outflow region of the vaporous fluid into the conducting chamber 14 is larger, in order to improve, in particular to increase, cooling of the vapour.

FIG. 11 shows, for example, a diametrical perspective view of the heat exchanger 82. It can be seen from FIG. 11 that it is also conceivable for the winding spacing between two windings 83 to be smaller in the outflow region of the vaporous fluid out of the conducting chamber 14 than in the inflow region.

Preferably, a vapour duct 30 is arranged between the pipeline 56 and the container 45, wherein the outflow region 11, in particular which is also referred to as the flow region 11, is connected to the vapour duct 30, in order to conduct the vaporous fluid throughout through the container 45 via the vapour duct 30; "conduct throughout through the container 45" is to be understood as "conduct beyond the container 45 away". The vaporous fluid is pulled in through the second compressor during operation of the second compressor stage 20. As a result, the vaporous fluid is conducted through the vapour duct 30, as can be seen for example, from FIG. 8.

A fluid conducting channel 15 preferably extends from the outflow region 11 laterally into the vapour duct 30, in order to supply the intermediate cooling fluid flowing through the heat exchanger 82 to the container 45, via the vapour duct 30 (see FIG. 8). The outflow region 11 extends from an outlet of the first compressor stage into the vapour duct 30 and into the evaporator part 54. The fluid conducting channel 15 extends through a wall, in particular a base, of the upper evaporator part 54. The intermediate cooling fluid flowing through the heat exchanger 82 collects in a base region of the upper evaporator part 54 and forms a fluid level 51. If the fluid level 51 of the upper evaporator part 54 is above the extension of the fluid conducting channel 15 throughout through the wall, then the intermediate cooling fluid can flow out into the vapour duct 30, via the fluid conducting channel 15, in particular due to gravity.

The suction manifold 12 is preferably funnel-shaped, having a maximum diameter 16 and a minimum diameter 17 opposite one another, wherein the conducting chamber 14 for conducting the compressed vaporous fluid extends axially to the minimum diameter 17 of the funnel shape. The maximum diameter 16 can adjoin the base of the upper evaporator part 54, as a result of which the intermediate cooling fluid flowing through the heat exchanger 82 is collected outside the suction manifold 12 of the first compressor stage 10, in the base region (see FIG. 8).

The conducting chamber 14 is designed preferably curved at an end which transitions into the upper evaporator part 54, in order to conduct the vaporous fluid, flowing through the conducting chamber 14, in a direction counter to a gas flow direction in the suction manifold. In particular, the vaporous fluid leaving the conducting chamber 14 is conducted into the vapour duct 30 if the second compressor stage is in operation, or into the vapour-conducting line 92 if the second compressor stage is not in operation.

The conducting chamber 14 preferably has a volume having a circle or an oval as a footprint. The conducting chamber 14 is arranged substantially perpendicularly to the minimum diameter 16 of the suction manifold 12 of the first compressor stage 10. The conducting chamber is in particular arranged in the upper evaporator part 54. The second compressor stage 20 furthermore also comprises a conducting chamber 14 which is arranged substantially perpendicularly to the minimum diameter 16 of the suction manifold 12 of the second compressor stage 20. The conducting chamber 14 of the first or the second compressor stage 10, 20 may also have any other configuration of footprint.

A further heat exchanger 82 is preferably arranged in the vapour duct 30 spaced apart from the outflow region 11. The further heat exchanger 82 is preferably arranged in an suction manifold 12 of the second compressor stage 20. The first and the second compressor stage 10, 20 are connected via the vapour duct 30, wherein the vapour duct 30 is arranged between a pressure side of the first compressor stage 10 and a suction side of the second compressor stage 20. The vapour duct 30 preferably has a curved shape having a sink 32. The container 45 is preferably arranged in the sink 32, such that liquid intermediate cooling fluid flows out of the vapour duct 30 and into the container 45. This can be seen for example, from FIG. 8.

The heat exchanger 82 and/or the further heat exchanger 82 preferably comprises/comprise, on its/their outer surface, an outer surface that is contoured at least in part, which is in contact with the vaporous fluid, in order to improve a heat transfer between the heat exchanger 82 and the vaporous fluid. The heat exchanger 82 and/or the further heat exchanger 82 preferably comprises/comprise, on its/their inner surface, an inner surface that is contoured at least in part, which is in contact with the fluid from the container 45, in order to bring about the configuration of a turbulent flow on their inner surface. The contoured inner and/or outer surfaces can comprise grooves and/or reliefs, i.e. recesses/elevations of any desired shape.

Preferably, for self-regulation of a fluid filling level, the condenser sump 64 and/or the evaporator sump 52 and/or the container 45 is/are in each case interconnected via a fluid conducting channel 15 in a fluidically conducting manner, such that the fluid level 51 of the individual sumps 52, 45, 64 is controlled, in particular only using gravity. In other words, the fluid level 51 of the individual sumps 52, 45, 64 is set passively on account of the geometric arrangement and the interconnection of the individual sumps 52, 45, 64 (see, for example FIG. 1, 2, 8 or 12 to 14). In the present case, self-regulation means passive regulation, i.e. without further technical means. It is also conceivable, however, to provide also active regulation of the fluid filling level of the sumps 52, 45, 64 by means of pumps, in which for example a controller can be provided, as well as filling level sensors which detect the filling level in the sumps 52, 45, 64.

A return line 2, which is in particular also referred to as a fluid conducting channel 15, for conducting fluid out of the condenser sump 64, preferably extends from the condenser sump 64 into the container 45 or the intermediate cooling sump 44. Further preferably, a fluid conducting channel 15 for conducting fluid out of the container 45 or the intermediate cooling sump 44 extends from the container 45 or the intermediate cooling sump 44, respectively, into the evaporator sump 52, wherein, in particular the fluid conducting channel 15 extends laterally into the evaporator sump 52 under the fluid level 51 of the evaporator sump 52, beginning from a base of the container 45 or of the intermediate cooling sump 44. The container 45 is preferably an intermediate cooling sump 44 of an intermediate cooler 40.

The heat pump 100 preferably comprises an intermediate cooling recirculation pump 22, in order to supply intermediate cooling fluid from the container 45 to the pipeline 56. In this embodiment of the heat pump 100, the intermediate cooling fluid feed line 3 can extend from the container 45 to the pipeline 56 (see FIG. 8). In the embodiments of FIGS. 12, 13 and 14, the intermediate cooling recirculation pump 22 can supply intermediate cooling fluid from the evaporator sump 52 to the pipeline 56.

FIG. 9 is a hydraulic diagram of the indirect intermediate cooling stage 8 having an indirect heat exchanger 82. It can be seen from FIG. 9, in a simplified view, that the vapour duct 30 extends to the second compressor stage 20 from the upper evaporator part 54, in which, in particular the first compressor of the first compressor stage 10 is arranged and in which the heat exchanger 82 can be arranged. Compressed fluid emerging from the first compressor stage 10 can thus be conducted via the vapour duct 30 to the second compressor stage 20. Furthermore, one of the fluid conducting channels 15, in which the fluid flowing through the heat exchanger 82 can be conducted into the container 45, extends beginning from the arranged heat exchanger 82. The legend of FIG. 9 further shows that the fluid line channels 15 and the intermediate cooling fluid feed line 3 conduct liquid fluid, i.e. in the present case water. It can furthermore be seen that the vapour duct 30 between the first and the second compressor stage 10, 20 is an active vapour path. In the present case, active vapour path means that the second compressor stage 20 is in operation, such that compressed fluid that leaves the first compressor stage is suctioned through the second compressor stage 20. In contrast, the bridging channel 62 between the first compressor stage and the condenser 60 is an inactive vapour path. In the present case, inactive vapour path means that the second compressor stage 20 is not in operation and the cross-section reducing element 70 is open, such that compressed fluid that leaves the first compressor stage is conducted directly into the condenser 60, via the bridging channel 62.

According to a further preferred embodiment, the heat pump 100 comprises the evaporator 50 for evaporating a fluid in order to obtain an evaporated fluid, wherein the evaporator 50 comprises the evaporator sump 52. The heat pump 100 further comprises the compressor having the first compressor stage 10 and the second compressor stage 20, wherein the compressor is arranged in the flow direction of the evaporated fluid, during operation of the heat pump 100, between the evaporator 50 and the condenser 60, and is configured to compress the evaporated fluid in order to obtain compressed fluid. The condenser 60 serves for condensing the compressed fluid. Furthermore, the heat pump 100 comprises the intermediate cooler 40, which is connected to an intermediate cooling fluid feed line 3, and the effect element 42, wherein the effect element is arranged between the first compressor stage 10 and the second compressor stage 20 and is configured to bring about an interaction between an intermediate cooling fluid which can be supplied via the intermediate cooling fluid feed line 3, and a heated vaporous fluid that can be discharged from the first compressor stage 10. The intermediate cooling fluid feed line 3 extends from the evaporator sump 52 to the effect element 42. Such a preferred embodiment of the heat pump is shown as a hydraulic diagram in FIG. 12 for example. FIG. 12 further shows the hydraulic diagram from which a feed of the intermediate cooling stage can be seen, wherein the intermediate cooling stage is fed from the evaporator sump 52. Fluid from the evaporator sump 52 is supplied to the effect element 42 via the intermediate cooling fluid feed line 3, such that the fluid from the evaporator sump 52 can be used for sprinkling evaporated and compressed fluid which passes the intermediate cooler 40 that is arranged in the vapour duct 30.

The intermediate cooling fluid feed line 3 preferably extends through an opening in the evaporator sump 52, and wherein the opening of the intermediate cooling fluid feed line 3 is located below a fluid level 51 of the fluid in the evaporator sump 52. The fluid from the evaporator sump 52 can flow into the intermediate cooling fluid feed line 3, in particular making use of gravity. In particular, the intermediate cooling fluid feed line 3 does not require a controller for supplying fluid from the evaporator sump 52. It is conceivable, however, to provide a controller for supplying the intermediate cooling fluid feed line 3 with liquid fluid.

As shown in FIG. 12, the intermediate cooler 40 preferably comprises an intermediate cooling sump 44, wherein beginning from a base of the intermediate cooling sump a return line 2 or a fluid conducting channel 15 for returning fluid from the intermediate cooling sump 44 into the evaporator sump 52 extends into the evaporator sump 52, preferably laterally. In particular, the heated vaporous fluid that can be discharged from the first compressor stage 10, and the intermediate cooling fluid, can each be taken out of the evaporator sump 52.

A further return line 1, which can be, in particular, also referred to as a fluid conducting channel 15, for returning fluid out of the condenser sump 64 into the evaporator sump 52, preferably extends from the condenser sump 64 directly into the evaporator sump 52, preferably laterally. In particular the return line 2 and the further return line 1 are fluidically separated from one another. "Fluidically separated from one another" means that the fluid from the return line 2 and the further return line 1 cannot mix in a line, but are mixed together first in the evaporator sump 52. With respect to the lines 1, 2 and 3, FIGS. 12 and 14 show an identical arrangement of the lines 1, 2, 3.

FIG. 14 shows a further preferred embodiment of the heat pump 100 as is shown in FIG. 12. FIG. 14 shows a hydraulic diagram as in FIG. 12, showing a feed of the intermediate cooling stage with additional filling materials 7 and/or additional further intermediate cooling stages 4, 5, wherein each of the intermediate cooling stage 4, 5 is fed from the evaporator sump 52.

According to the further preferred embodiment of the heat pump as shown in FIG. 14, the intermediate cooling fluid feed line 3 is connected to at least one further intermediate cooler 4, 5. The further intermediate cooler 5 can be arranged in the vapour duct 30 between the evaporator 50 and the condenser 60. The further or the still further intermediate cooler 4, 5 can, in particular be arranged after an outlet of the first compressor stage 10.

As shown in the embodiments according to FIGS. 12 and 14, the intermediate cooling sump 44 is configured for collecting fluid that can flow through the intermediate cooling fluid feed line 3, wherein the fluid can be supplied from the intermediate cooling sump 44 to the evaporator sump 52 via the return line 2, or also referred to as the fluid conducting channel 15. In particular the return line 2 and the further return line 1 each comprise an opening 55 to the evaporator sump 52 at spaced positions of the evaporator sump 52. In particular, the opening 55 of the further return line 1 is arranged in the evaporator sump 52 under a fluid level 51 of the evaporator sump 52. More particularly, the opening 55 of the return line is arranged in the evaporator sump 52 under a fluid level 51 of the evaporator sump 52.

The intermediate cooling fluid feed line 3 or a motor cooling line 33 is preferably arranged from the evaporator sump 52 to a motor cooling stage 34 of the first compressor stage 10, in order to conduct fluid out of the evaporator sump 52 to the motor cooling stage 34 for cooling a motor M assigned to the first compressor stage 10. In particular, the intermediate cooling fluid feed line 3 and/or the motor cooling line 33 extends/extend from the evaporator sump 52 via the motor cooling stage 34 of the first compressor stage 10 to the effect element 42, in order to conduct fluid out of the evaporator sump 52 to the motor cooling stage 34 for cooling a motor M assigned to the first compressor stage 10, and to the effect element 42 (see FIGS. 12 and 14).

As can further be seen from FIGS. 12 and 14, a further motor cooling line 35 is arranged from the evaporator sump 52 to a further motor cooling stage 36 of the second compressor stage 20, in order to conduct fluid out of the evaporator sump 52 to the further motor cooling stage 36 for cooling a motor M assigned to the second compressor stage 20. The motors M, which are assigned to the compressor stages 20, 30, 80, can be cooled using fluid from the evaporator sump 52. The fluid from the evaporator sump 52 is cooler than the fluid from an intermediate cooling sump 44. The fluid from one of the intermediate cooling sumps 44 is in turn cooler than the fluid from the condenser sump 64.

As can be seen for example in FIG. 1, 2, 8 or 12 to 15, a ball bearing adapter line 74 can preferably be arranged from the intermediate cooling sump 44 to a ball bearing adapter 76 which is assigned to the first compressor stage 10, in order to conduct fluid out of the intermediate cooling sump 44 for cooling the at least one ball bearing adapter 76. In particular, a compressor cooling channel 77 is arranged from an outlet of the ball bearing adapter 76 to the first compressor stage 10, in order to conduct fluid out of the ball bearing adapter 76 to the first compressor stage 10, in order to sprinkle compressed fluid in the first compressor stage 10 with the fluid from the ball bearing adapter 76.

Further preferably a ball bearing adapter line 74 is arranged from the condenser sump 64 to a ball bearing adapter 76 which is assigned to the second compressor stage 20, in order to conduct fluid out of the condenser sump 64 for cooling the at least one ball bearing adapter 76. In particular, a compressor cooling channel 77 is arranged from an outlet of the ball bearing adapter 76 to the second compressor stage 20, in order to conduct fluid out of said ball bearing adapter 76 to the second compressor stage 20, in order to sprinkle compressed fluid in the second compressor stage 20 with the fluid from the ball bearing adapter 76 which is assigned to the second compressor stage 20. In an embodiment that is not shown, the ball bearing adapter can also receive fluid for cooling from the intermediate cooling fluid feed line 3 and thus be connected, in series or in parallel, to the same line to which the motor cooling stage 36 is also connected.

Preferably, at least one filling material 7 for discharging heat, in particular for enlarging the surface and thus for optimised cooling of the vapour, is arranged in a region around the first compressor stage 10. The at least one filling material 7 is arranged, in particular around the suction manifold 12 of the first compressor stage 10 (compare with FIG. 14). In a particularly advantageous embodiment, the at least one filling material comprises a large number of individual filling materials which are distributed around the suction manifold 12 of the first compressor stage 10.

As can be seen for example from FIG. 14, preferably a still further intermediate cooler 4 is arranged in the intermediate cooling fluid feed line 3. In particular, due to the arrangement of the intermediate cooler 40, the further intermediate cooler 4 and the still further intermediate cooler 5, the vapour, i.e. the evaporated and compressed fluid, passes, in the intermediate cooling fluid feed line 3, after emerging from the first compressor stage 10, first through the further intermediate cooler 4 and subsequently the still further intermediate cooler 5 and/or the intermediate cooler 40. It is conceivable for the heat pump 100 to comprise only the further intermediate cooler 4 and the still further intermediate cooler 5 (see FIG. 14). It is further conceivable for the heat pump 100 to comprise only the intermediate cooler 40 (see FIG. 12). It is further conceivable for the heat pump 100 to comprise only the intermediate cooler 40 and the further intermediate cooler 4 or the still further intermediate cooler 5. In an embodiment that is not shown, it is also possible for the intermediate cooler 5 to extend over the entire length of the vapour duct 30, and thus particularly efficient cooling of the vapour flowing past is brought about.

The further intermediate cooler 4 is preferably configured as a heat exchanger 82 which is configured as a pipeline 56 and/or as a pipe bundle **56*a* and has a pipe volume through which fluid from the evaporator sump 52 flows, in order to allow for indirect cooling 8 of the vapour. FIG. 8 to 10 show, for example, the indirect cooling 8 by the heat exchanger 82. The heat exchanger 82** has already been described in detail, to which reference is made at this point.

Preferably, the second compressor stage 20 is arranged between the evaporator 50 and the condenser 60, and the intermediate cooler 40, the further intermediate cooler 4 and/or the still further intermediate cooler 5 are arranged at a spacing from a suction region of the second compressor stage 20. As can be seen, for example in FIG. 14, the intermediate cooler 40 and/or the further intermediate cooler 4 and/or the still further intermediate cooler 5 can be arranged in the upper evaporator part 54 and/or, proceeding from the first compressor stage 10, in the vapour duct 30 as far as the sink 32.

In order to regulate a fluid filling level, i.e. a fluid level 51, the condenser sump 64 and/or the evaporator sump 52 and/or the intermediate cooling sump 44 can each comprise level control. A level control can preferably be omitted, provided that the fluid level 51 in the individual sumps 52, 44, 64 controls itself by way of the level of the outflows, i.e. provided that self-regulation, as already described, is possible. The fluid level 51 then does not need to be actively controlled. In the present case, outflows means, for example the opening 65 of the vapour-conducting line 92 into the condenser 60, and/or the opening 65 of the return line 2 into the intermediate cooling sump 44, and/or the opening 65 of the intermediate cooling fluid feed line 3 into the evaporator sump 52, as is shown for example in FIGS. 12, 13 and 14.

As already explained, FIG. 15 shows a compressor characteristic diagram 170 of an N-stage compressor, wherein the compressor characteristic diagram 170 defines a relationship between a pressure ratio and a mass flow.

FIG. 16 shows a three-dimensional enveloping surface 180 over a corrected mass flow, wherein the dotted lines show measured rotational speed characteristic curves 181. The rotational speed characteristic curves 181 are dependent on the corrected mass flow WCcorr and the compression ratio PiC. Similarly to in FIG. 15, in FIG. 16 the pump limit 171 is plotted depending on the corrected mass flow and the compressor ratio. The enveloping surface 180 is shown as a compensation surface (3D fit), which has been adjusted to the measured rotational speed characteristic curves 181. The enveloping surface 180 initially rises with an increasing corrected mass flow and increasing rotational speed, and is shown as a three-dimensionally monotonically increasing function. After reaching a mass flow of approximately 0.8, the enveloping surface 180 exhibits a monotonically decreasing course.

FIG. 17 shows a three-dimensional illustration for determining the volume flow for ascertaining the corrected mass flow. The volume flow is given by a function which depends on the drawn electrical power Pei and the rotational speed of the compressor stage 10, 20. Preferably, in the heat pump 100 compressor stages 10, 20 are used which are identical in structure. It is conceivable to use compressor stages 10, 20 which differ from one another.

The volume flow cannot be measured directly. Said flow is instead determined indirectly via a stored 3D characteristic diagram 190 which is specific for a compressor drive used. The volume flow is derived in the 3D characteristic diagram 190 depending on the drawn electrical power Pei and the rotational speed of the compressor drive, with the aid of the 3D characteristic diagram in the 3D characteristic diagram 190 (see dotted curves 191), in that the measured values 191 are plotted in the 3D characteristic diagram 190. After the volume flow has been determined, the mass flow can be corrected, in particular by applying knowledge of the molar mass of the fluid at a given pressure and a given temperature.

According to a preferred embodiment, the heat pump 100 comprises the evaporator 50 for evaporating a fluid in order to obtain an evaporated fluid; the condenser 60 for condensing a compressed fluid; and the compressor having a first compressor stage 10 and a second compressor stage 20, wherein the compressor is arranged in the flow direction of the evaporated fluid, during operation of the heat pump 100, between the evaporator 50 and the condenser 60, and is configured to compress the evaporated fluid, in order to obtain the compressed fluid. Furthermore, the heat pump 100 comprises a value acquisition device 95 for acquiring a first value P1, which corresponds to a first pressure ratio between an inlet of the first compressor stage 10 and an outlet of the first compressor stage 10, or is dependent on the first pressure ratio; and a controller 96 for controlling a first rotational speed of the first compressor stage 10 and a second rotational speed of the second compressor stage 20, wherein the controller 96 is configured to control the second rotational speed of the second compressor stage 20 depending on the first value P1. The value acquisition device 95 and the controller 96 can communicate with one another, and can in each case communicate with components of the heat pump 100, as is indicated in FIG. 18 by the arrows in opposite directions. The outlet of the first compressor stage 10 comprises a region immediately after the first compressor stage 10 as well as a region between the first compressor stage 10 and the second compressor stage 20, in particular a region in the vapour duct 30.

The value acquisition device 95 is preferably configured for acquiring a second value P2, which corresponds to a second pressure ratio between an outlet of the second compressor stage 20 and an inlet of the first compressor stage 10, or is dependent on the second pressure ratio, and wherein the controller 96 is configured to furthermore control the second rotational speed depending on the second value P2. In particular, a region of the inlet of the second compressor stage 20 can adjoin the region of the outlet of the first compressor stage 10. For example, the region of the outlet of the first compressor stage 10 can end in the sink 32, and the region of the inlet of the second compressor stage 20 can begin in the sink 32 of the vapour duct 30 (see FIG. 18).

FIG. 18 shows the hydraulic diagram of the heat pump 100, in which the first temperature sensor 91, the second temperature sensor 92 and the third temperature sensor 93 are shown. Furthermore, FIG. 18 shows the controller 96 and the value acquisition device 95 which in each case communicate with the individual components of the heat pump 100 and also with one another. The cooling liquid 97 specifies the cold water temperature which the user of the heat pump 100 is provided as the actual temperature. The first temperature sensor 91 measures the first temperature TI1 in the evaporator sump 52 and thus before the first compressor stage 10. The second temperature sensor 92 measures the second temperature TI3 in the intermediate cooling sump 44 and thus after the first compressor stage 10 and before the second compressor stage 20. The third temperature sensor 93 measures the third temperature TI2 in the condenser sump 64 and thus after the second compressor stage. As FIG. 18 indicates, a cooling capacity 103 is made available to the user, which serves as the capacity for cooling condensation water. This is capacity that is provided to the user or customer. The discharged heat capacity 105 is heat capacity that is discharged via a heat exchanger used as cooler. The motors M of the compressor stages 10, 20 consume the electrical power 104, which is the consumed power of the heat pump 100 which is consumed via the two compressor stages 10, 20. For example, a maximum pressure ratio of the first compressor stage 10 can be P1=3.7. For example, a maximum pressure ratio of the second compressor stage 20 can be P2=3.7. In this case, for example the maximum overall pressure ratio $P_{ges}$ of the heat pump 100 can be $P_{ges}$=P1*P2=3.7*3.7=13.7. In conjunction with FIG. 19, it is possible to furthermore summarise that in the case 1 the first compressor stage 10 is operated constantly at a pressure ratio of, for example P1=2.7, and the second compressor stage 20 is operated at a pressure ratio P2 between zero and 2.7. If the first compressor stage 10 and the second compressor stage 20 are each operated at a pressure ratio of P1=P2=2.7, the heat pump 100 switches from case (first power region 98) to case 2 (second power region 99). In the second power region 99, the compression ratios of the first compressor stage 10 and of the second compressor stage 20 each increase uniformly from P1=P2=2.7 to P1=P2=3.7.

The controller 96 is preferably configured to use the first value P1 as the actual value and the second value P2 as the target value. Further preferably, the controller 96 is configured to increase the rotational speed of the second compressor stage 20 when the actual value is greater than the target value, or to reduce the rotational speed of the second compressor stage 20 when the actual value is less than the target value. By comparing the actual value with the target value, the rotational speeds of the first and second compressor stage 10, 20 can in each case be set such that the second compressor stage can be used efficiently, independently of the first compressor stage 10. An independent setting of the rotational speeds of the first and second compressor stage 10, 20 is achieved in that each motor M of the compressor stages 10, 20 comprises its own motor shaft, which is to be driven. The first value P1 specifies a compression ratio of the first compressor stage 10 according to P1=TI3/TI1. The second value P2 specifies a compression ratio of the second compressor stage 20 according to P2=TI2/TI3.

The value acquisition device 95 is preferably furthermore configured to ascertain an actual temperature of a cooling fluid 97 discharged on the evaporator side, and in which the controller 96 is configured to set the rotational speed of the first compressor stage 10 in a manner dependent on the actual temperature of the cooling fluid 97 and a predefined target temperature of the cooling fluid 97. During operation of the heat pump 100, it can increase the actual temperature of the cooling fluid 97 discharged on the evaporator side, since the fluid circulating in the heat pump, i.e. the cooling fluid 97, assumes a higher temperature over time due to the operation of the heat pump 100.

The controller is preferably configured to operate the first compressor stage 10 at a higher pressure ratio than the second compressor stage 20, depending on a power requirement in a first power region 98, wherein a difference between the pressure ratios of the first compressor stage 10 and the second compressor stage 20 reduces at increasing power requirements (see case 1 in FIG. 19), and, in order to operate both the first compressor stage 10 and the second compressor stage 20, in a second power region 99, in such a way that pressure ratios of the two compressor stages 10, 20 are approximately identical, in the second power region 99, or, in particular are identical within a range of plus/minus 20 percent, and/or increase identically as the power requirement increases (see case 2 in FIG. 19), wherein the second power region 99 has higher power requirements than the first power region 98, wherein a boundary 94 between the first power region 98 and the second power region 99 is specified by the first compressor stage 10 and/or by the second compressor stage 20. FIG. 19 shows a diagram for illustrating control of the compressor stages 10, 20 of the heat pump 100 depending on the rotational speeds of the first and second compressor stages 10, 20 in the first power region 98 and in the second power region 99. In case 2, i.e. the second power region 99, a higher power T is converted than in the first case, i.e. in the first power region 98 (compare with FIG. 19). It can furthermore be seen from FIG. 19 that the first compressor stage 10 operates at a constant power value, in particular of $\pi$=2.7. The constant power value $\pi$ of the first compressor stage 10 corresponds to a target value in the first line region 98 at which the first compressor stage is intended to be operated. The second compressor stage 20 begins with an initially low power $\pi$, but increasingly moves closer to the target value of the first power stage 10. If the second compressor stage 20 also reaches the target value of the power T, both of the compressor stages 10, 20 switch into an operation which corresponds to case two, i.e. the second power region 99. In the second power region, the pressure ratio of the first compressor stage 10 and of the second compressor stage 20 preferably increase uniformly. At the boundary 94, there is a switch from operation in the first power region 98 to operation in the second power region 99. In particular in the case of an overall pressure ratio of $(\rho(TI2)/\rho(TI1))^{1/2}$ the heat pump 100 switches from operation in the first power region 98 to operation of the second power region 99, wherein $\rho$(TI1) specifies a saturated vapour pressure in the evaporator sump 52, which can in particular be measured by the first temperature sensor 91, and wherein $\rho$(M) specifies a saturated vapour pressure in the condenser sump 64, which can in particular be measured by the third temperature sensor 93 (compare with FIG. 18).

The first compressor stage 10 and the second compressor stage 20 preferably comprise radial wheels of different sizes, wherein the controller 96 is configured to control the first compressor stage 10, in the first power region 98, to a constant first pressure ratio as the target value, and to control the second compressor stage 20, with increasing power requirement, to an increasing second pressure ratio as the target value, and to fulfil, in the second power region 99, with an increasing power requirement both by the first compressor stage 10 and also by the second compressor stage 20 (compare with FIG. 19). For example, in the compressor stages 10, 20 used, the target value is 2.7, as has already been stated. When different compressor stages are used, the target value may be different. In particular, the target value is specific to the compressor. The radial wheel of the first compressor stage 10 is preferably configured larger than the radial wheel of the second compressor stage 20. Both radial wheels are in particular configured such that they both pass through approximately the same mass flow. Since in front of the second radial wheel, i.e. the radial wheel of the second compressor stage 20, the temperature is higher than in front of the first radial wheel, i.e. the radial wheel of the first compressor stage 10, the second radial wheel must be performed smaller.

The controller 96 is preferably configured to use a maximum value from a function of the second value P2 or a predefined constant konst. as the target value for controlling the second rotational speed of the second compressor stage 20. The predefined constant depends on the compressors used and is preferably in the range between 1 and 5, i.e. 1≤konst.≤5, more preferably in the range between 2 and 4, particularly advantageously the constant is konst=2.7. The constant is the optimum pressure ratio of the first compressor. The maximum value of the second rotational speed of the second compressor stage 20 is therefore given by:

$$\text{maximum value}=P2 \text{ or konst.}$$

The maximum value is given by a maximum function which takes the higher value from the second value P2 or from a predefined constant konst.

The maximum function is preferably a root function, and the predefined constant is the boundary 94 between the first and the second power region 98, 99. The maximum function is in particular given by $$(\rho(T/2)/\rho(T/1))^{\frac{1}{2}}$$

wherein ρ(TI1) specifies a saturated vapour pressure in the evaporator sump (52), which can, in particular be measured by the first temperature sensor 91, and wherein ρ(TI2) specifies a saturated vapour pressure in the condenser sump 64, which can, in particular be measured by the third temperature sensor 93 (compare with FIG. 18).

The first value P1 is given by the ratio from: P1=TI3/TI1.

The second value P2 is given by the ratio from: P2=TI2/TI3.

An overall compression ratio $P_{ges}$, as is plotted in FIG. 19, is given by the product of the first value P1 and the second value P2, specifically by:

$$P_{ges} = P1 * P2 = (TI3/TI1) * (TI2/TI3) = TI2/TI1$$

As can be seen for example from FIG. 19, the first value P1 and the second value P2 are added geometrically (i.e. 2*α/2=α), in order to obtain the overall compression ratio $P_{ges}$.

The value acquisition device 95 preferably comprises a first temperature sensor for acquiring a first temperature TI1 with respect to the evaporator 50, and a second temperature sensor for acquiring a second temperature TI3 with respect to an outlet of the first compressor stage 10, wherein the value acquisition device 95 is configured to determine the first value P1 from the first temperature TI1 and the second temperature TI3. FIG. 18 shows for example where, in the hydraulic diagram of the heat pump 100, the temperature sensors could be arranged, in that the locations where the temperature TH1, TI2 and TI3 can be measured are indicated.

The first temperature sensor is preferably arranged in the evaporator sump 52 of the evaporator 50, in order to acquire the first temperature TI1 before the first compressor stage 10, and the second temperature sensor is arranged in an intermediate cooling sump 44, in order to acquire the second temperature TI3 after an outlet of the first compressor 10. The outlet of the first compressor 10 preferably comprises the sink 32 in the vapour duct 30, which fluidically connects the first compressor stage 10 and the second compressor stage 20.

The vapour duct 30 is preferably provided between the first compressor stage 10 and the second compressor stage 20, in order to conduct compressed fluid out of the first compressor stage 10 into the second compressor stage 20, wherein the intermediate cooling sump 44 or the container 45 is arranged in the vapour duct 30. The first compressor stage 10 and the second compressor stage 20 are fluidically interconnected via the vapour duct 30.

As can be seen from FIG. 18, the value acquisition device 95 comprises a third temperature sensor, in order to measure a third temperature TI2, wherein the value acquisition device 95 is configured to ascertain the second value P2 from the third temperature TI2 and the first temperature TI1. The third temperature sensor is preferably arranged in the condenser sump 64, in order to acquire the third temperature TI2 after the second compressor stage 20. FIG. 18 is a hydraulic diagram which highlights temperature sensors for conducting of the second compressor, in particular where the temperature sensors could be arranged in the heat pump 100, in order to measure the respective temperatures TI1, TI2 or TI3. As shown, for example in FIG. 8, the second temperature sensor can, instead of in the intermediate cooling sump 44, also be arranged in the container 45, i.e. in a sump 44, 45 which fluidically interconnects the first compressor stage 10 and the second compressor stage.

A fluid conducting channel 15 preferably extends from the condenser sump 64 into the intermediate cooling sump 44 (FIG. 18) or into the container 45 (FIG. 8), in order to conduct fluid out of the condenser sump 64 into the intermediate cooling sump 44 or into the container 45, and wherein a further fluid conducting channel 15 extends from the intermediate cooling sump 44 or the container 45 into the evaporator sump 52, in order to conduct fluid out of the intermediate cooling sump 44 or the container 45 into the evaporator sump 52. Interconnecting the sumps 64, 44, 45 and 52 via the fluid lines 15 increases the fluid in each of the sumps 64, 44, 45 and 52 during the course of operation of the heat pump 100. As a result, it may be already the case, on account of a duration of the operation of the heat pump 100, that this requires control of the compressor stages of the heat pump, as shown in FIG. 19.

Preferably a bridging channel 62 is arranged between the first compressor stage 10 and the condenser 60, in order to bridge the second compressor stage 20, wherein a cross-section reducing element 70 is arranged in the bridging channel 62, in order to set a cross-section of the bridging channel 62 for controlling a through-flow of compressed fluid out of the first compressor stage 10 to the condenser 60, wherein the cross-section reducing element 70 assumes a closed position during operation of the second compressor stage 20. The bridging channel 62 and the cross-section reducing element 70 have already been described in detail, to which reference is made.

The rotational speeds of the compressor stages 10, 20 can be increased for two reasons, since both the user side and the cooler side act on the heat pump. For example, the cold water temperature 97 may increase. The water used by the user, which is provided to him, is simply of a higher temperature, i.e. the user requires more cooling capacity. In this case, the rotational speed of the first compressor stage 10 is adjusted upwards, as a result of which more electrical power 104 is supplied to the heat pump 100. As a result, the cooling capacity 103 generated by the heat pump increases. In another case, the cold water temperature 97 may increase if the water temperature from the heat exchanger used as cooler to the liquefier increases, for example if the outside temperature increases and the heat exchanger used as cooler can discharge the heat energy only with greater energy expenditure. In this case, for example the measured temperatures TI1, TI3 and TI2 increase, as a result of which ultimately the cold water temperature increases, which reaches the user. For the operation of the compressor stages 10, 20 this means that initially the rotational speed of the first compressor stage is adjusted upwards and then, in a temporally offset manner, the rotational speed of the second compressor stage is also adjusted upwards. Thus, in the case of an increase in the cooling water temperature the consumed electrical power 104 of the heat pump 100 also increases.

The second compressor can be used more efficiently by means of the heat pump described herein, as a result of which the heat pump per se can be used more efficiently. Furthermore, the second compressor stage is prevented from being operated in the pump limit or in the swallowing limit.

In particular, the first compressor stage provides the user with a required cooling capacity. The second compressor stage 20 discharges the heat from the heat pump 100 to the heat exchanger used as cooler. When the first compressor stage 10 provides the user with more cooling capacity, the compressor stage 20 outputs more heat capacity to the heat exchanger used as cooler, as a result of which the consumed electrical power of the heat pump increases.

A further aspect relates to a method for operating a heat pump 100 comprising an evaporator 50 for evaporating a fluid in order to obtain an evaporated fluid, wherein the evaporator 50 has an evaporator sump 52; a condenser 60 for condensing an evaporated fluid compressed by an N-stage compressor, wherein the condenser 60 has a condenser sump 64, a condensation region 66 and a holding region 67 for holding a vaporous fluid still remaining after the condensation region 66; the N-stage compressor which comprises N compressors, wherein N is a natural number greater than or equal to one, wherein the N-stage compressor is arranged between the evaporator 50 and the condenser 60; a vapour duct 30 which couples at least two of the N compressors of the N-stage compressor between the evaporator 50 and the condenser 60, and a vapour-conducting line 92 which is arranged between the condenser 60 and the evaporator 50, in order to conduct vaporous fluid out of the holding region 67 of the condenser 60 into the evaporator 50, which method comprises the following steps:

evaporating fluid by the evaporator 50;

supplying the evaporated fluid into the first compressor stage 10, in order to compress the evaporated fluid, conducting the compressed fluid through the vapour duct 30 in order to pass the N compressors, in order to ultimately reach the condenser 60;

condensing the compressed fluid in the condensation region 66 and holding non-condensed fluid in the holding region 67; and returning the evaporated fluid via the vapour-conducting line 92 out of the holding region 67 to the evaporator 50.

A further aspect relates to a method for producing a heat pump 100 comprising an evaporator 50 for evaporating a fluid, in order to obtain an evaporated fluid, wherein the evaporator 50 has an evaporator sump 52; a condenser 60 for condensing an evaporated fluid compressed by an N-stage compressor, wherein the condenser 60 has a condenser sump 64, a condensation region 66 and a holding region 67 for holding a vaporous fluid still remaining after the condensation region 66; the N-stage compressor which comprises N compressors, wherein N is a natural number greater than or equal to one, wherein the N-stage compressor is arranged between the evaporator 50 and the condenser 60; a vapour duct 30 which couples at least two of the N compressors of the N-stage compressor between the evaporator 50 and the condenser 60, and a vapour-conducting line 92 which is arranged between the condenser 60 and the evaporator 50, in order to conduct vaporous fluid out of the holding region 67 of the condenser 60 into the evaporator 50, which method comprises the following steps:

arranging the evaporator 50 of the N-stage compressor and of the condenser 60; connecting the evaporator of the N-stage compressor and of the condenser 60 via the vapour duct 30; and connecting the evaporator and the condenser 60 via the vapour-conducting line 92, in order to create a circuit in which the fluid circulates.

A further aspect relates to a method for operating a heat pump 100 comprising an evaporator 50 for evaporating a fluid, in order to obtain an evaporated fluid, wherein the evaporator 50 has an evaporator sump 52; a condenser 60 for condensing a compressed fluid, wherein the condenser 60 comprises a condenser sump 64; a compressor having a first compressor stage 10 and a second compressor stage 20, wherein the compressor is arranged in the flow direction of the evaporated fluid, during operation of the heat pump 100, between the evaporator 50 and the condenser 60, and is configured to compress the evaporated fluid, in order to obtain the compressed fluid; wherein the method comprises the following steps:

collecting an intermediate cooling fluid in a container 45; and a through-flow of the intermediate cooling fluid from the container 45 through a heat exchanger 82 with a pipeline 56, wherein the pipeline 56 is arranged in a flow region 11 between the first compressor stage 10 and the second compressor stage 20, in order to cool vaporous fluid in the flow region 11.

A further aspect relates to a method for producing a heat pump 100 comprising an evaporator 50 for evaporating a fluid in order to obtain an evaporated fluid, wherein the evaporator 50 comprises an evaporator sump 52; a condenser 60 for condensing a compressed fluid, wherein the condenser 60 comprises a condenser sump 64; a compressor having a first compressor stage 10 and a second compressor stage 20, wherein the method comprises:

arranging the compressor in the flow direction of the evaporated fluid, such that during operation of the heat pump 100 the compressor is arranged between the evaporator 50 and the condenser 60, in order to compress the evaporated fluid, in order to obtain the compressed fluid;

arranging a container 45 for collecting an intermediate cooling fluid; and arranging a heat exchanger 82 having a pipeline 56 in a flow region 11 between the first compressor stage 10 and the second compressor stage 20, in order, during operation of the heat pump, to create a through-flow of the intermediate cooling fluid from the container 45 through the pipeline 56, and in order to cool vaporous fluid in the flow region 11.

A further aspect relates to a method for operating a heat pump 100 comprising an evaporator 50 for evaporating a fluid in order to obtain an evaporated fluid, wherein the evaporator 50 comprises an evaporator sump 52; a compressor having a first compressor stage 10 and a second compressor stage 20, wherein the compressor is arranged in the flow direction of the evaporated fluid, during operation of the heat pump 100, between the evaporator 50 and the condenser 60, and is configured to compress the evaporated fluid, in order to obtain the compressed fluid; and the condenser 60 for condensing the compressed fluid; and an intermediate cooler 40, which is connected to an intermediate cooling fluid feed line 3 and comprises an effect element 42, wherein the effect element 42 is arranged between the first compressor stage 10 and the second compressor stage 20, wherein the method comprises:

supplying intermediate cooling fluid from the evaporator sump 52 into the effect element 42 via the intermediate cooling fluid feed line 3;

discharging a heated vaporous fluid through the first compressor stage 10;

causing the intermediate cooling fluid, which can be supplied via the intermediate cooling fluid feed line 3, to interact with the heated vaporous fluid discharged from the first compressor stage 10, in order to cool the vaporous fluid.

A further aspect relates to a method for producing a heat pump 100 comprising an evaporator 50 for evaporating a fluid, in order to obtain an evaporated fluid, wherein the evaporator 50 comprises an evaporator sump 52; a compressor having a first compressor stage 10 and a second compressor stage 20, wherein the compressor is arranged in the flow direction of the evaporated fluid, during operation of the heat pump 100, between the evaporator 50 and a condenser 60, and is configured to compress the evaporated fluid, in order to obtain compressed fluid; and the condenser 60 for condensing the compressed fluid; wherein the method comprises:

arranging an intermediate cooler 40 comprising an effect element 42 between the first compressor stage 10 and the second compressor stage 20;

connecting the intermediate cooler 40 to an intermediate cooling fluid feed line 3 which extends from the evaporator sump 52 to the effect element 42, in order to bring about, during operation of the heat pump 100, an interaction between an intermediate cooling fluid which can be supplied via the intermediate cooling fluid feed line 3, and a heated vaporous fluid that can be discharged from the first compressor stage 10.

A further aspect relates to a method for operating a heat pump 100 comprising an evaporator 50 for evaporating a fluid, in order to obtain evaporated fluid; a condenser 60 for condensing a compressed fluid; a compressor having a first compressor stage 10 and a second compressor stage 20, wherein the compressor is arranged in the flow direction of the evaporated fluid, during operation of the heat pump 100, between the evaporator 50 and the condenser 60, and is configured to compress the evaporated fluid, in order to obtain the compressed fluid, and a bridging channel 62 between the first compressor stage 10 and the condenser 60, wherein the method comprises:

bridging the second compressor stage 20 by setting a cross-section of a cross-section reducing element 70 in the bridging channel 62, in order to control a through-flow of compressed fluid out of the first compressor stage 10 to the condenser 60.

A further aspect relates to a method for producing a heat pump 100 comprising an evaporator 50 for evaporating a fluid, in order to obtain evaporated fluid; a condenser 60 for condensing a compressed fluid; a compressor having a first compressor stage 10 and a second compressor stage 20, wherein the compressor is arranged in the flow direction of the evaporated fluid, during operation of the heat pump 100, between the evaporator 50 and the condenser 60, and is configured to compress the evaporated fluid, in order to obtain the compressed fluid; wherein the method comprises:

arranging a bridging channel 62 between the first compressor stage 10 and the condenser 60, in order to bridge the second compressor stage 20;

arranging a cross-section reducing element 70 in the bridging channel 62, in order to set a cross-section of the bridging channel 62, in order to control a through-flow of compressed fluid out of the first compressor stage 10 to the condenser 60.

A further aspect relates to a method for operating a heat pump 100 comprising an evaporator 50 for evaporating a fluid, in order to obtain an evaporated fluid; a condenser 60 for condensing a compressed fluid; and a compressor having a first compressor stage 10 and a second compressor stage 20, wherein the compressor is arranged in the flow direction of the evaporated fluid, during operation of the heat pump 100, between the evaporator 50 and the condenser 60, and is configured to compress the evaporated fluid, in order to obtain the compressed fluid, said method comprising the following steps:

acquiring a first value P1, which corresponds to a first pressure ratio between an inlet of the first compressor stage and an outlet of the first compressor stage, or is dependent on the first pressure ratio; and controlling a first rotational speed of the first compressor stage 10 and a second rotational speed of the second compressor stage 20, wherein the second rotational speed of the second compressor stage 20 is controlled depending on the first value P1.

A further aspect relates to a method for producing a heat pump 100 comprising: an evaporator 50 for evaporating a fluid in order to obtain an evaporated fluid; a condenser 60 for condensing a compressed fluid; and a compressor having a first compressor stage 10 and a second compressor stage 20, said method comprising the following steps:

arranging the compressor in the flow direction of the evaporated fluid, during operation of the heat pump 100, between the evaporator 50 and the condenser 60, in order to compress the evaporated fluid, in order to obtain the compressed fluid; and connecting a value acquisition device, for acquiring a first value, which corresponds to a first pressure ratio between an inlet of the first compressor stage and an outlet of the first compressor stage, or is dependent on the first pressure ratio, to the compressor, the evaporator or the condenser; and connecting a controller, for controlling a first rotational speed of the first compressor stage 10 and a second rotational speed of the second compressor stage 20, to the compressor, wherein the second rotational speed of the second compressor stage 20 is controlled depending on the first value.

As already mentioned in the general part, individual aspects which are described with reference to the heat pump can also be implemented as method steps.

Preferably, a method for producing a heat pump 100, as described above, can be provided by preparing the individual features and combining the individual features to one of the heat pump 100 as described above. In the present case, the individual features are not discussed again in connection with the production method for the heat pump. Rather, at this point, reference is made to the above description of the individual features, which can be understood as production method steps.

A method for operating a heat pump 100 further preferably initially comprises providing a heat pump 100 as described above.

For operating the heat pump, at least one, in particular the first, compressor stage 10 is operated. During operation of the first compressor stage 10, fluid is evaporated via the evaporator 50 and thus supplied to the first compressor stage. At the same time, liquid fluid is supplied to an effect element 42 and/or a heat exchanger 82 via the intermediate cooling fluid feed line 3. Evaporated and compressed fluid which leaves the first compressor stage 10 is cooled as has already been described above. The method for operating a heat pump 100 further comprises setting the cross-section reducing element 70 into an open or closed position or an intermediate position, as already described above. Depending on the position of the cross-section reducing element 70, the evaporated and compressed fluid, which leaves the first compressor stage 10, is either conducted directly to the condenser 60 by the bridging channel 62 (inactive vapour path) and/or conducted to the second compressor stage 20 via the vapour duct 30 (active vapour path). In the case of an intermediate position of the cross-section reducing element 70, in particular the inactive and the active vapour path can be used for conducting the evaporated and compressed fluid. A description of the circulation of the fluid already follows from the above description, which is not repeated again in connection with the method for operating the heat pump, in order to avoid redundancies. Rather, at this point too, reference is made to the above description, which can also be understood as method steps for operating the heat pump.

In particular, the various features described can be combined with one another or exchanged with one another as desired. In particular, fluid and cooling water are used synonymously. In particular the use of the word "vapour" means evaporated fluid.

LIST OF REFERENCE SIGNS

1 further return line
3 intermediate cooling fluid return line
2 return line
4 further intermediate cooler
5 still further intermediate cooler
7 filling material
8 indirect intermediate cooling stage
10 first compressor stage
11 flow region
12 suction manifold
14 conducting chamber
15 fluid conducting channel
16 maximum diameter
17 minimum diameter
20 second compressor stage
22 recirculating pump
30 vapour duct (banana)
32 sink
33 motor cooling line
34 motor cooling
35 further motor cooling line
36 further motor cooling
40 intermediate cooler
42 effect element
44 intermediate cooling sump
45 container
46 first intermediate cooler line
48 second intermediate cooler line
49 ball bearing adapter
50 evaporator
51 fluid level
52 evaporator sump
54 upper evaporator part
55 opening in the evaporator
56 pipeline
56*a* pipe bundle
56*b* helical pipe arrangement
57 sprinkling region
58 sprinkling device
59 first evaporator line
60 condenser
62 bridging channel
64 condenser sump
65 opening of a line into a sump
66 condensation region
67 holding region
68 filling level
70 cross-section reducing element
72 diameter of the cross-section reducing element
74 ball bearing adapter line
76 ball bearing adapter
77 compressor cooling channel
80 n-th compressor stage
82 heat exchanger
83 winding
90 vapour transmission flap/bridging flap
92 vapour-conducting line
91 first temperature sensor
92 second temperature sensor
93 third temperature sensor
94 boundary
95 value acquisition device
96 controller
97 actual temperature of a cooling fluid discharged on the evaporator side
98 first line region
99 second line region
TI1 first temperature
TI3 second temperature
TI2 third temperature
100 heat pump
101 helical line
102 helix axis
103 cooling capacity
104 electrical power
105 discharged power
170 compressor characteristic diagram/boundary lines
171 pump limit
172 dotted lines
180 enveloping surface
181 rotational speed characteristic curve
P1 first value/actual value
P2 second value/target value
M motor
300 test bench
301 compressor to be tested
302 pressure sensor
303 temperature sensor
304 vapour passage
306 pipe
307 throttle valve
308 return
309 sensor
310 pump
311 connection
2' evaporator
3' first compressor
4' intermediate cooling stage
4*a*' intermediate cooling sump
4*c*' pump
5' second compressor
6' condenser
41' container
71' supply line
72' supply line
V0 vapour bypass
50' evaporator
60' condenser

The invention claimed is:

1. A heat pump having the following features:

an evaporator for evaporating a fluid in order to obtain an evaporated fluid, wherein the evaporator comprises an evaporator sump;

a condenser for condensing a compressed fluid, wherein the condenser has a condenser sump;

a compressor having a first compressor stage and a second compressor stage, wherein the compressor is arranged in a flow direction of the evaporated fluid, during operation of the heat pump, between the evaporator and the condenser, and is configured to compress the evaporated fluid in order to obtain the compressed fluid;

a container for collecting an intermediate cooling fluid; and a heat exchanger having a pipeline, which is configured for the intermediate cooling fluid to flow through from the container, wherein the pipeline is arranged in a flow region between the first compressor stage and the second compressor stage, in order to cool vaporous fluid in the flow region, and wherein the pipeline is arranged around an intake manifold of the first compressor stage such that the intermediate cooling fluid flowing through the pipeline indirectly cools the vaporous fluid in the flow region without direct contact between the intermediate cooling fluid and the vaporous fluid.

2. The heat pump according to claim 1, wherein the pipeline is made of metal, preferably the pipeline comprises stainless steel or copper.

3. The heat pump according to claim 1, wherein the pipeline comprises a region in which the pipeline extends in a helical or spring-shaped manner, wherein the region that extends in a spring-shaped or helical manner comprises windings having different winding spacings.

4. The heat pump according to claim 1, wherein the first compressor stage comprises an intake manifold for suctioning the evaporated fluid, and a conducting chamber for conducting the vaporous fluid into the flow region.

5. The heat pump according to claim 4, wherein the pipeline of the heat exchanger is arranged around the intake manifold of the first compressor stage, wherein a winding spacing between two windings in an inflow region of the vaporous fluid of the first compressor stage is larger than in an outflow region of the vaporous fluid flowing into the conducting chamber.

6. The heat pump according to claim 5, wherein a vapour duct is arranged between the pipeline and the container, wherein the outflow region is connected to the vapour duct, in order to conduct the vaporous fluid through the container via the vapour duct.

7. The heat pump according to claim 6, wherein a fluid conducting channel extends from the outflow region laterally into the vapour duct, in order to supply the intermediate cooling fluid flowing through the heat exchanger to the container, via the vapour duct.

8. The heat pump according to claim 4, wherein the intake manifold is funnel-shaped, having a maximum diameter and a minimum diameter opposite one another, wherein the conducting chamber for conducting the compressed vaporous fluid extends axially to the minimum diameter of the funnel shape.

9. The heat pump according to claim 4, wherein the conducting chamber is configured curved at an end which transitions into an upper evaporator part, in order to conduct the vaporous fluid, flowing out of the conducting chamber, in a direction counter to a gas flow direction into the intake manifold, in particular wherein the conducting chamber has a volume having a circle or an oval as the footprint.

10. The heat pump according to claim 6, wherein a further heat exchanger is arranged in the vapour duct so as to be spaced apart from the outflow region, preferably wherein the further heat exchanger is arranged in an intake manifold of the second compressor stage.

11. The heat pump according to claim 6, wherein the first and the second compressor stage are connected via the vapour duct, wherein the vapour duct is arranged between a pressure side of the first compressor stage and a suction side of the second compressor stage, in particular wherein the vapour duct has a curved shape having a sink, wherein the container is arranged in the sink such that liquid intermediate cooling fluid flows out of the vapour duct into the container.

12. The heat pump according to claim 1, wherein the heat exchanger comprises, on its outer surface, an outer surface that is contoured at least in part, which is in contact with the vaporous fluid, in order to improve the heat transfer between the heat exchanger and the vaporous fluid, and wherein the further heat exchanger forms a heat exchanger arranged in a vapour duct between the first compressor stage and the second compressor stage so as to be spaced apart from an outflow region of the first compressor stage.

13. The heat pump according to claim 1, wherein the heat exchanger comprises, on its inner surface, an inner surface that is contoured at least in part, which is in contact with the fluid from the container, in order to bring about the configuration of a turbulent flow on its inner surface, and wherein the further heat exchanger forms a heat exchanger arranged in a vapour duct between the first compressor stage and the second compressor stage so as to be spaced apart from an outflow region of the first compressor stage.

14. The heat pump according to claim 1, wherein for regulating a fluid level the condenser sump, the evaporator sump and the container are in each case fluidically interconnected via a fluid channel, such that the level of the individual sumps is controlled, in particular wherein a first return channel for returning fluid from the condenser sump extends from the condenser sump into the container, in particular wherein a second return channel for returning fluid from the container extends from the container into the evaporator sump, and/or in particular wherein the second return channel extends laterally into the evaporator sump below a fluid level of the evaporator sump, proceeding from a base of the container.

15. The heat pump according to claim 1, wherein the heat pump comprises an intermediate cooling recirculation pump, in order to supply intermediate cooling fluid from the container to the pipeline, in particular wherein the container is an intermediate cooling sump of an intermediate cooler.

16. A method for operating a heat pump comprising an evaporator for evaporating a fluid in order to obtain an evaporated fluid, wherein the evaporator comprises an evaporator sump; a condenser for condensing a compressed fluid, wherein the condenser comprises a condenser sump; a compressor having a first compressor stage and a second compressor stage, wherein the compressor is arranged in a flow direction of the evaporated fluid, during operation of the heat pump, between the evaporator and the condenser, and is configured to compress the evaporated fluid in order to obtain the compressed fluid; wherein the method comprising the steps of:

collecting an intermediate cooling fluid in a container; and causing the intermediate cooling fluid to flow from the container through a heat exchanger with a pipeline, wherein the pipeline is arranged in a flow region between the first compressor stage and the second compressor stage, in order to cool vaporous fluid in the flow region, and wherein the pipeline is arranged around an intake manifold of the first compressor stage such that the intermediate cooling fluid flowing through the pipeline indirectly cools the vaporous fluid in the flow region without direct contact between the intermediate cooling fluid and the vaporous fluid.

17. A method for producing a heat pump comprising an evaporator for evaporating a fluid, in order to obtain an evaporated fluid, wherein the evaporator comprises an evaporator sump; a condenser for condensing a compressed fluid, wherein the condenser has a condenser sump; a compressor having a first compressor stage and a second compressor stage, wherein the method comprises:

arranging the compressor in a flow direction of the evaporated fluid, such that during operation of the heat pump the compressor is arranged between the evaporator and the condenser, in order to compress the evaporated fluid, in order to obtain the compressed fluid;

arranging a container for collecting an intermediate cooling fluid; and arranging a heat exchanger having a pipeline in a flow region between the first compressor stage and the second compressor stage, in order, during operation of the heat pump, to create a flow of the intermediate cooling fluid from the container through the pipeline, and, in order to cool vaporous fluid in the flow region, and wherein the pipeline is arranged around an intake manifold of the first compressor stage such that the intermediate cooling fluid flowing through the pipeline indirectly cools the vaporous fluid in the flow region without direct contact between the intermediate cooling fluid and the vaporous fluid.

* * * * *